US007079077B2

(12) United States Patent
Lee

(10) Patent No.: US 7,079,077 B2
(45) Date of Patent: Jul. 18, 2006

(54) METHODS AND APPARATUS FOR IMPLEMENTATION OF AN ANTENNA FOR A WIRELESS COMMUNICATION DEVICE

(75) Inventor: Choon Sae Lee, Dallas, TX (US)

(73) Assignee: Southern Methodist University, Dallas, TX (US)

( * ) Notice: Subject to any disclaimer, the term of this patent is extended or adjusted under 35 U.S.C. 154(b) by 62 days.

(21) Appl. No.: 10/770,540

(22) Filed: Feb. 2, 2004

(65) Prior Publication Data

US 2005/0168383 A1 Aug. 4, 2005

(51) Int. Cl.
*H01Q 1/38* (2006.01)

(52) U.S. Cl. ..... 343/700 MS; 343/846

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 4,839,659 | A * | 6/1989 | Stern et al. | 343/700 MS |
| 5,144,320 | A * | 9/1992 | Stern et al. | 342/374 |
| 5,278,569 | A * | 1/1994 | Ohta et al. | 343/700 MS |
| 5,389,937 | A * | 2/1995 | Kaloi | 343/700 MS |
| 5,504,466 | A * | 4/1996 | Chan-Son-Lint et al. | 333/159 |
| 6,133,878 | A | 10/2000 | Lee | |
| 6,281,847 | B1 | 8/2001 | Lee | |
| 6,313,798 | B1 * | 11/2001 | Bancroft et al. | 343/700 MS |
| 6,369,760 | B1 | 4/2002 | Nalbandian et al. | |
| 6,552,686 | B1 * | 4/2003 | Ollikainen et al. | 343/700 MS |
| 6,628,241 | B1 | 9/2003 | Fukushima et al. | |
| 6,633,262 | B1 | 10/2003 | Shoji et al. | |
| 6,759,990 | B1 * | 7/2004 | Rossman | 343/700 MS |
| 6,919,857 | B1 | 7/2005 | Shamblin et al. | |
| 2003/0034920 | A1 | 2/2003 | Lee | |
| 2003/0151556 | A1 * | 8/2003 | Cohen | 343/700 MS |

OTHER PUBLICATIONS

Lee, et al., "A Simple Circular-Polarized Antenna: Circular Waveguide Horn Coated with Lossy Magnetic Material," *IEEE Transactions on Antennas and Propagation*, vol. 36, No. 2, Feb. 1998. pp. 297-300.

Lee, et al., "Electrically Small Microstrip Antennas," *IEEE AP-S International Symposium Digest*, 2000, pp. 778-781.

Lee, et al., "Size Reduction of Microstrip Antennas," *Electronic Letters*,vol. 37, No. 21, Oct. 11, 2001, pp. 1274-1275.

Tseng, et al., "Enhanced Radiation Efficiency of Electrically Small Microstrip Antennas," *Microwave and Optical Technology Letters*, Oct. 2003, pp. 62-64, Letter 39.

* cited by examiner

*Primary Examiner*—Tho Phan
(74) *Attorney, Agent, or Firm*—Slater & Matsil, L.L.P.

(57) ABSTRACT

A wireless communication device includes an antenna configured with two conductive elements separated by an insulating medium providing a separation distance. One conductive element is a ground plane and the other is a microstrip line. The microstrip line and the ground plane exhibit a characteristic impedance that may vary along the length of the microstrip line. The separation distance of the microstrip line from the ground plane is changed to reduce the resonant frequency of the microstrip line. A second microstrip line with an open end and another end shorted to the ground plane is operative to prevent RF current from flowing on the backside of the ground plane. A backside of the ground plane and the second microstrip line may be covered with a lossy magnetic medium to reduce the near field in the space above the backside of the ground plane.

35 Claims, 19 Drawing Sheets

METHODS AND APPARATUS FOR IMPLEMENTATION OF AN ANTENNA FOR A WIRELESS COMMUNICATION DEVICE

TECHNICAL FIELD

The present invention relates to methods and apparatus for providing a microstrip antenna of compact size such as may be used in wireless communication devices and the like.

BACKGROUND

The widespread use of cellular telephones and other compact or portable RF communication devices such as toll-tag readers, identification card readers, and devices for scanning items in inventory has resulted in intense interest in employing antennas with high efficiency and compact size. The early implementations of mobile cellular telephony devices were of lunchbox size or larger, and required a power level that generally required a substantial power source such as provided by an automotive alternator and battery. However, as cellular technology has evolved with paralleling reductions in size and power requirements, cellular telephones and other portable communication devices have become small enough to fit easily into the palm of one's hand, and can be operated for practical periods of time from a small internal rechargeable battery. Similarly, scanners for recognizing tagged items in inventory have become very compact and portable.

Over the years of development of radio and related telecommunication technologies, numerous antenna configurations have been developed. An antenna is a circuit element configured to convert RF (radio frequency) energy flowing in circuit conductors into a radiated form that can propagate freely in space. An antenna exhibits reciprocal properties in that the same physical configuration can receive as well as transmit radiation with substantially similar characteristics.

A basic antenna configuration is a dipole which is a conductive line, insulated at both ends, coupled to an RF power source near, but not necessarily at, its center. A monopole antenna is a variation of a dipole antenna that consists of half a dipole adjacent to a conductive plane configured to provide a mirrored electromagnetic field that functionally replaces the missing dipole half. An alternative to a dipole is a conductive loop of wire, also fed from an RF power source coupled to the wire ends.

Further variations of these antenna configurations include the addition of directive and reflective conductive elements that provide directivity to the radiated signal from the antenna, parabolic conductive surfaces to focus the radiated beam, waveguide termination configurations, microstrip lines, and combinations of these approaches.

From,a design perspective an antenna is required to exhibit a number of characteristics to make it a practical circuit element for use with a communication device. One characteristic is that it exhibits reasonable "gain", which relates to its radiation directivity and efficiency. Directivity refers to the directional variation of its transmitting and receiving properties. Relatively omnidirectional transmitting and receiving characteristics are often desired for portable communication devices, which avoid the need for the user to maintain an orientation of the device in a particular direction while communicating. Small dipole and loop antennas inherently exhibit substantially omnidirectional transmitting and receiving characteristics.

Efficiency refers to the fraction of power that is radiated compared to the total power delivered to the antenna, a portion of which is lost in the resistance of conductive elements and dielectric media. The need for high efficiency is related to the use of smaller batteries and smaller power processing circuit elements, since the amount of RF power that would otherwise have to be generated can be reduced. Efficiency is important because batteries make a significant cost and size contribution to the design of cellular telephones.

Another property of interest is the antenna input impedance. This refers to the ratio of voltage to current, including any phase difference that is applied to the terminals of the antenna, and affects possible need for additional circuit components that would otherwise be included for efficient coupling of power to the antenna. Antenna bandwidth refers to the variation of any property over a range of frequencies, and is an indication of the antenna's utility for a particular band of frequencies that may be allocated for its intended use.

As the size of cellular telephones has been reduced, the size of the antenna has also been reduced. Early cellular telephones utilized a monopole antenna about a quarter wavelength in length, which was often retractable within the body of the communication device when not in use. Since the present frequency bands for cellular communication are at about 1 and 2 GHz, the corresponding length of an extended monopole antenna is about 3.2 or 1.6 inches, respectively. This has been a practical arrangement for some early portable telephones, but the continuing pressures of the marketplace provide advantage to products with antennas of even smaller size.

Microstrip antennas, which consist of a conductive strip on an insulating substrate applied over a conductive surface, have been an important step in reducing antenna size because of the absence of a mechanical structure projecting from the end of the telephone such as a monopole antenna. A microstrip antenna can effectively be a layered structure on a surface of the telephone requiring little volume without compromising good transmitting and receiving performance. Nonetheless, the length of the conductive layer has been required to be on the order of a quarter wavelength in order to achieve reasonable antenna performance as measured by input impedance, antenna gain, bandwidth, or other parameter required by the design. Microstrip length has become a limitation as cellular telephones continue to shrink. In general, most antennas exhibit a compromise in performance when their size is substantially smaller than a quarter wavelength of the transmitted or received signal.

Telephones incorporating monopole and microstrip antennas are described in U.S. Pat. No. 6,633,262 (Shoji, et al.), U.S. Pat. No. 6,628,241 (Fukushima, et al.), U.S. Pat. No. 6,281,847 (Lee), and U.S. Pat. No. 6,133,878 (Lee), which are incorporated herein by reference.

With widespread utilization of cellular telephones, a new characteristic, specific absorption rate (SAR) has become a parameter of great importance. SAR refers to the power absorbed in adjacent tissues of the head during transmitting operation of a cellular telephone. SAR represents a perceived risk for long term exposure of head tissues as a consequence of the deep penetration of RF radiation in tissues of biological origin at frequencies used for cellular communication. Thus, it is desirable that SAR be reduced as much as possible. SAR is already a characteristic that is limited for cellular devices sold in certain countries such as Japan and Korea, and SAR may also become limited in devices sold in the U.S. As general uses for compact and portable transmitters become widespread, personally absorbed radiation will become an issue of greater interest and concern.

Design directions that can be taken to limit SAR are reduction in transmitted power, which is undesirable because it limits the useful range of the telephone or other transmitting device, locating the antenna farther from a person's head or other body part so as to reduce personal exposure to RF energy, which raises marketability issues for cellular telephone and other portable or compact products, increasing antenna efficiency so that less power is required to operate the telephone or other communication device, which is presently a design challenge for small antennas, and possibly altering the configuration of the antenna and its adjacent structures to reduce strength of the near-field radiation adjacent the user's head or other body part without adversely affecting the antenna radiation pattern or other antenna attributes such as antenna gain, size, or input impedance.

There has been extensive research to make microstrip antennas more suitable for use particularly as cellular telephone antennas, mainly because the conducting ground plane may partially shield electromagnetic radiation of the near-field area on the backside of the ground plane, where a user's head is likely to be located. As the size of the ground plane is reduced, its effectiveness at reducing the near field on the second side of the ground plan is correspondingly reduced. A popular technique for size reduction of microstrip antennas is to use thin vertical conductors connecting the radiating patch and the ground plane as in a PIFA (planar inverted F-antenna). However, as indicated above, antenna size has not been reduced beyond a certain level without compromising antenna performance. In many practical applications, as in cellular telephones, such limited size reduction may not be sufficient.

Accordingly, there are needs in the art for new methods and apparatus for configuring an antenna that is usable with portable or compact communication equipment, that can be configured in sizes significantly less than a quarter wavelength yet preserve electrical characteristics of longer antennas such as input impedance, gain, and efficiency. In addition, the new antenna configuration should exhibit reduced SAR for absorption of electromagnetic energy in adjacent tissues of the head or in proximate surrounding surfaces that are likely to be exposed during intended operation of the device.

SUMMARY OF THE INVENTION

In accordance with one or more aspects of the present invention, a wireless communication device may include an antenna with at least two conductive elements separated by an insulating medium. The antenna is configured as a microstrip line with a characteristic impedance that may vary along the length of the strip. The separation distance of the conductive elements is changed at at least one location along the microstrip line so as to produce a corresponding change in the characteristic impedance of the microstrip line. This change in conductive element separation distance, which may or may not be abrupt, produces an electrical resonant frequency of the antenna that is lower than the resonant frequency of an antenna of the same length configured with a uniform conductive element separation distance.

In one embodiment, one of said conductive elements is preferably configured as a ground plane, and the other said conductive element is configured as a microstrip line separated from said ground plane by the insulating medium.

In one embodiment, the change in separation distance of the conductive elements is configured to be abrupt, producing an abrupt change in the local characteristic impedance of the microstrip line.

In one embodiment, the length of an antenna, configured as a microstrip line with at least one change in conductive element separation distance, is shorter than an antenna with uniform conductive element separation distance. Antennas that radiate with high efficiency are generally configured with lengths corresponding roughly to a quarter wavelength of the signal to be transmitted or received with one end open and one end shorted to a ground reference, or a half wavelength, with both ends open. Antennas can be configured with shorter lengths compared to a quarter or half wavelength, but antenna efficiency, as measured by a ratio of radiated power to the total power supplied to its terminals, ordinarily rapidly declines for antenna lengths substantially shorter than a quarter wavelength. This rapid deterioration of antenna performance for short antennas may be avoided by the invention herein disclosed.

In one further embodiment, the antenna is configured as a microstrip line with at least two conductive elements separated by an insulating medium, wherein one conductive element is configured as a ground plane with a first side and a second side and at least one edge, and the other conductive element is configured as a first microstrip line above said first side. The antenna preferably includes a third conductive element, with a first end and a second end, configured as a second microstrip line above said second side with an effective electrical length that is an odd multiple of about a quarter wavelength. Preferably, the third conductive element has an effective electrical length that is about a quarter wavelength. Antennas of multiple wavelengths may radiate, but are less useful in certain applications because of their large size and low efficiency. One end of the strip forming the second microstrip line preferably is open and configured to lie proximate an edge of said ground plane, and the other end of the second microstrip line is shorted to the ground plane. The third conductive element is configured as a second microstrip line above the second side of the ground plane with a characteristic impedance that may vary along the length of the second microstrip line. Accordingly, recognizing the general impedance inverting characteristics of a quarter wavelength transmission line, the second microstrip line can be configured with a length that is operative to obstruct currents on the first side of the ground plane from flowing over the edge of the ground plane onto the second side of the ground plane.

In one further embodiment the second microstrip line may be separated from the second side of the ground plane with at least one change in said separation distance. A change in separation distance at at least one location along the microstrip line and which may be abrupt is operative to cause a resonant frequency of the second microstrip line to be lower than a microstrip line with uniform separation distance from a ground plane. Accordingly, the length of said second microstrip line can be substantially shorter than a microstrip line with a uniform separation distance from a ground plane. Preferably, for efficient antenna operation, at least two changes in said separation distance are desired.

In accordance with one or more further aspects of the present invention, the change in said separation distance of said second microstrip line is abrupt.

In accordance with one or more further aspects of the present invention, the second microstrip line is configured with a curved end and the ground plane is configured with a curved edge. The curved end of the second microstrip line preferably is open and configured to lie proximate the curved edge of said ground plane. The other end of the second microstrip line is shorted to the ground plane. The second microstrip line can be thus configured to be operative to obstruct currents on the first side of the ground plane from flowing over the curved edge of the ground plane onto the second side of the ground plane.

In accordance with one or more further aspects of the present invention, a lossy magnetic medium may be applied over all or portions of the second side of the ground plane and over all or portions of the second microstrip line. The lossy magnetic medium can provide a mechanism to absorb radiated near fields that are a result of RF current that flows from the first side of the ground plane over an edge onto the second side of the ground plane, thereby reducing SAR.

In accordance with one or more further aspects of the present invention, a microstrip antenna is configured to lie above two sides of a ground plane by extending its conductive surface around an edge of the ground plane and remaining insulated from said edge.

In accordance with one or more further aspects of the present invention, a method includes configuring an antenna for a wireless communication device with at least two conductive elements, separating the conductive elements by an insulating medium, providing thereby a microstrip line with a characteristic impedance that may vary along its length. The separation distance of the conductive elements may be changed abruptly or more gradually at at least one location along the microstrip transmission line so as to produce a corresponding change in the microstrip line characteristic impedance. This change in conductor spacing produces an electrical resonant frequency of the antenna that is lower than the resonant frequency of an antenna of the same length configured with a uniform conductive element separation distance from a ground plane. Preferably, for efficient antenna operation, at least two changes in said separation distance are desired.

In accordance with one or more further aspects of the present invention, a method includes configuring an antenna with at least two conductive elements separated by an insulating medium, configuring one conductive element as a ground plane with a first side and a second side and at least one edge, and configuring the other conductive element as a first microstrip line above the first side with an insulating substrate therebetweeen. The method preferably includes configuring a third conductive element with a first end and a second end as a second microstrip line above the second side with an effective length that is an odd multiple of a quarter wavelength. The method preferably includes configuring the third conductive element with an effective length that is a quarter wavelength. A first end of the second microstrip line is preferably open and proximate an edge of the ground plane and the second end of the second microstrip line is shorted to the ground plane, so as to obstruct currents on the first side of the ground plane from flowing over the edge of the ground plane onto the second side of the ground plane.

In accordance with one or more further aspects of the present invention, a method includes configuring the separation distance of the conductive elements of the second microstrip line with abrupt or more gradual changes in the separation distance at at least one location along the second microstrip transmission line so that it can be configured with a length that is shorter than a microstrip transmission line with uniform conductive element separation distance. Preferably, for efficient antenna operation, at least two changes in said separation distance are desired.

In accordance with one or more further aspects of the present invention, a method includes applying a lossy magnetic medium over all or portions of the second side of the ground plane and over all or portions of the second microstrip line so as to provide a mechanism to absorb radiated near fields that are a result of RF current that flows from the first side of the ground plane over an edge onto the second side of the ground plane, thereby reducing SAR.

BRIEF DESCRIPTION OF THE DRAWINGS

For a more complete understanding of the present invention and the advantages thereof, reference is now made to the following descriptions taken in conjunction with the accompanying drawing, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
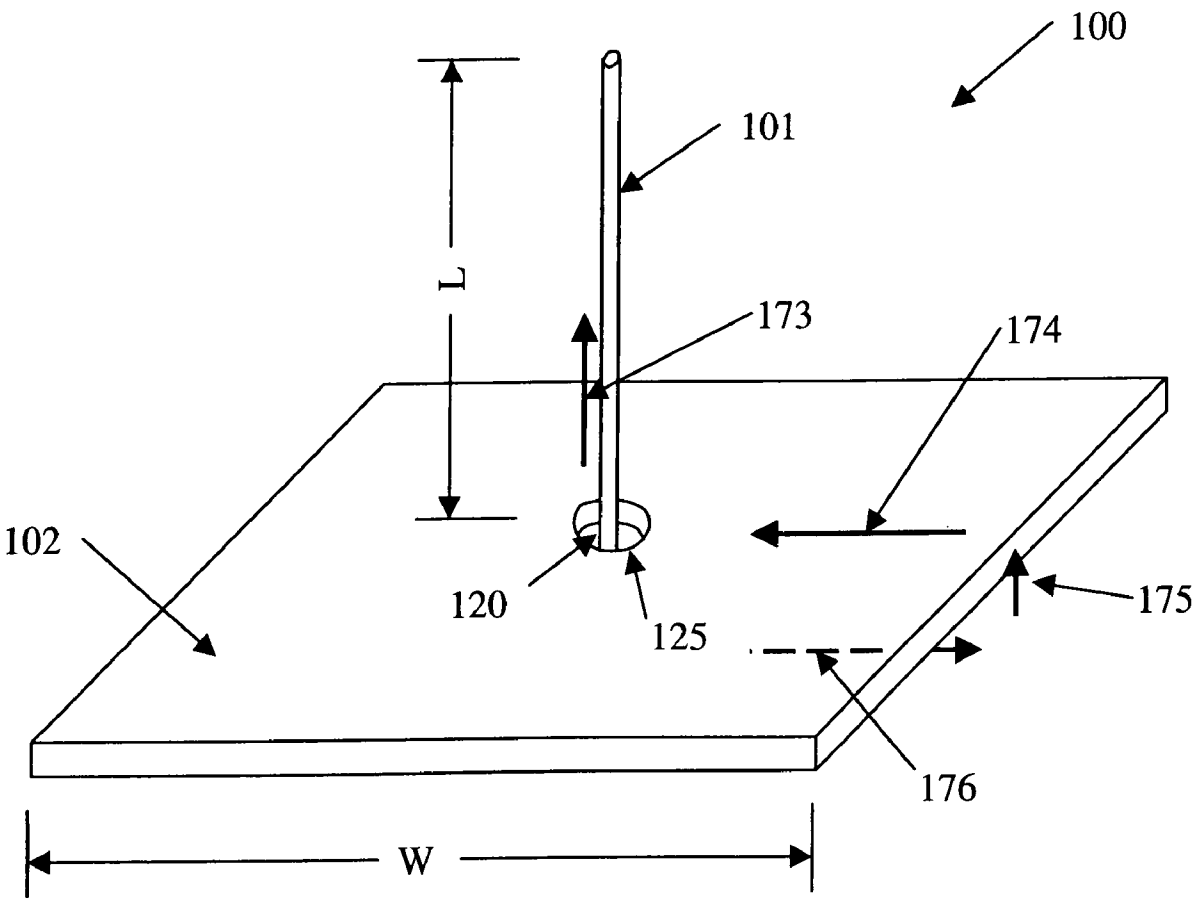
FIGURE 1 PRIOR ART
FIG. 1 illustrates a monopole antenna of the prior art.

Reference is now made to the drawings, wherein like designations indicate like elements, as well as numerals ending in the same last two digits. Referring initially to FIG. 1, a monopole antenna 100 of the prior art is illustrated. The monopole antenna 100 includes a conductive wire 101 extending above a ground plane 102. The monopole antenna is fed through an aperture 125 in the ground plane from a feed point 120 by an RF power source (not shown). The monopole antenna extends a distance L above the ground plane, typically about a quarter wavelength at the transmitting or receiving frequency. The ground plane has a width W that is generally on the order of half a wavelength or more.

An RF current 173 in the conductive wire 101 induces a flow of charge on the topside of the ground plane 102, producing at least partially a mirror image on the ground plane of the current in the conductive wire. The mirrored current creates the effect of a dipole antenna of length 2L. Ideally the width of the ground plane W is much longer than the wavelength of the radiated signal, but in practice the width W may be comparable to or shorter than a wavelength.

Current 174 induced on the topside of the ground plane 102 by the current 173 in conductive wire 101 encounters a discontinuity in conductivity at the edge of the ground plane. The result is to induce a current 175 that flows over the edge of the ground plane, and a corresponding current 176 that flows on the backside of the ground plane.

Ordinarily the ground plane 102 would be expected to provide a shielding effect for electromagnetic fields induced by the conductive wire 101 for the region facing the backside of the ground plane. However, as a consequence of its limited length W and limited dimension in the cross direction, currents induced on the backside of the ground plane as described above act as a radiating source for near fields to the region facing the backside of the ground plane.

If such an antenna arrangement were placed adjacent to a person's head, a substantial electromagnetic near field would be coupled thereto by backside currents such as RF current 176. Thus, disadvantages of this prior art antenna include the substantial length required for a conductive radiating wire extending above a ground plane, and the substantial electromagnetic near fields that are created on the backside of the antenna system.

Figure 2:
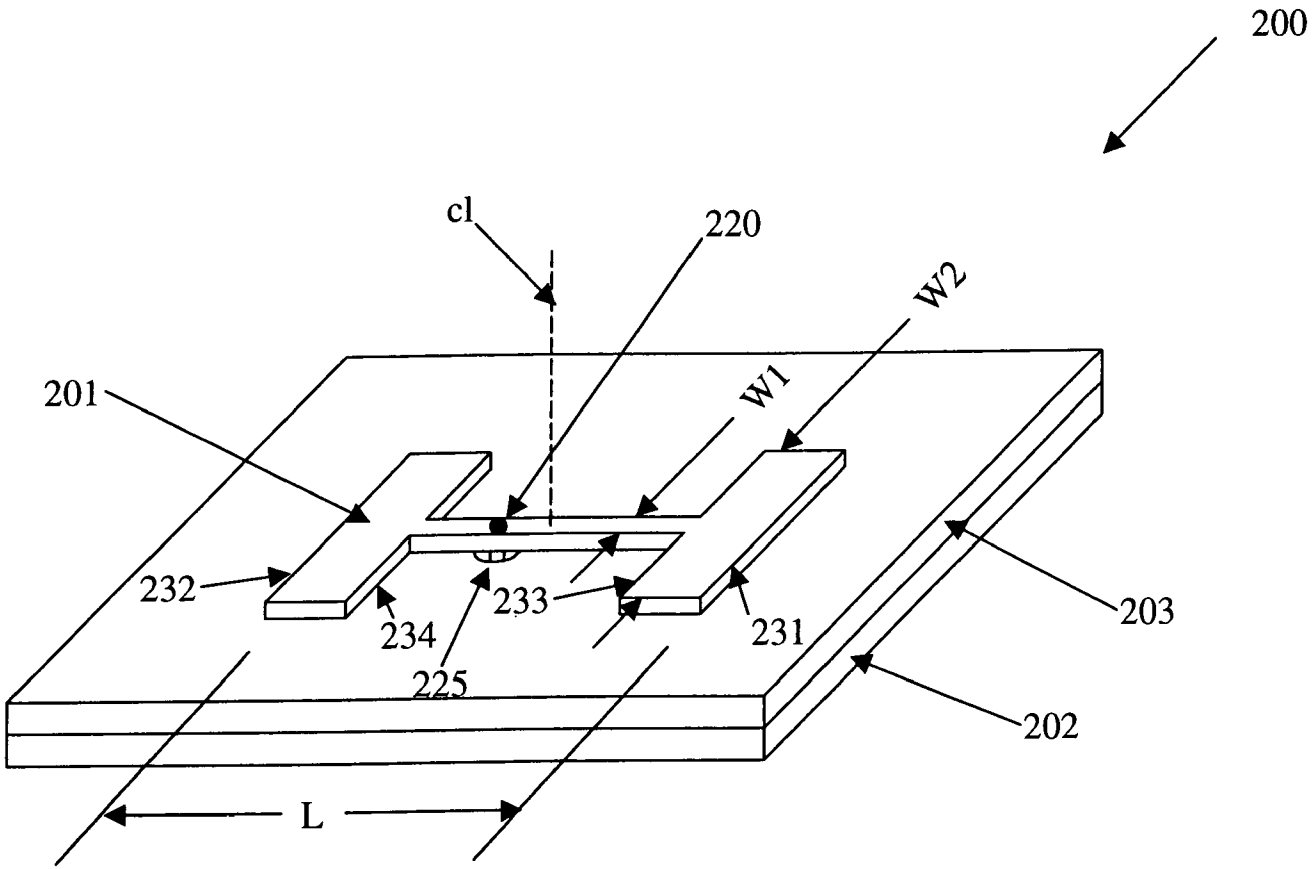
FIG. 2 illustrates a microstrip antenna with discontinuities in width.

Turning now to FIG. 2 illustrated is a microstrip antenna 200 described in co-pending patent application Ser. No. 10/214,746, filed Aug. 9, 2002, and incorporated herein by reference. The microstrip antenna includes a conductive radiating strip 201 that is separated from a ground plane 202 by an insulating substrate 203. The conductive radiating strip is fed by an RF power source (not shown) at the feed point 220, which is preferably coupled off-center to the radiating microstrip 201 to obtain the required antenna impedance, and which might ordinarily be coupled to an RF power source on the backside of the ground plane through an aperture 225 in the ground plane 202 in a manner that may be similar to the arrangement illustrated on FIG. 1. The center of the conductive radiating strip 201 is identified on FIG. 2 with the dashed line labeled "cl" (for center line). The coupling on the backside of the ground plane to the feed point 220 may be made with a coaxial connector with a flange grounded to the ground plane (not shown).

The length L of the conductive radiating strip 201 would ordinarily be about or somewhat less than a half wavelength of the signal to be radiated. However, discontinuities in the width of the conductive radiating strip, illustrated on the figure by the unequal widths W1 and W2, provide corresponding discontinuities in the characteristic impedance of the strip line forming the radiating strip, producing an antenna with a length L substantially less than half a wavelength but with some properties of an antenna with a length much closer to a half wavelength.

To create substantial discontinuities in strip line characteristic impedance so as to accommodate a shorter length of the radiating strip, substantial differences in the widths W1 and W2 are used. A strip line with a width reasonably greater than the separation from the underlying ground plane 202 exhibits a characteristic impedance roughly proportional to the ratio of its separation distance from the ground plane to its width. Substantial discontinuities in strip line width thus produce substantial discontinuities in characteristic impedance. These discontinuities result in long edges in the radiating strip such as edges 233 and 234 illustrated on FIG. 2. The equivalent magnetic currents at the opening edges 231 and 232 of the conductive radiating strip 201 generally conduct current in directions opposite to those on edges 233 and 234, which make little net contribution to the radiated field while the conduction loss remains about the same. The field cancellation effect reduces the efficiency of this antenna configuration and results in limited opportunity to construct an antenna with short length compared to a half wavelength of the radiated signal without compromising antenna performance.

Figure 3A:
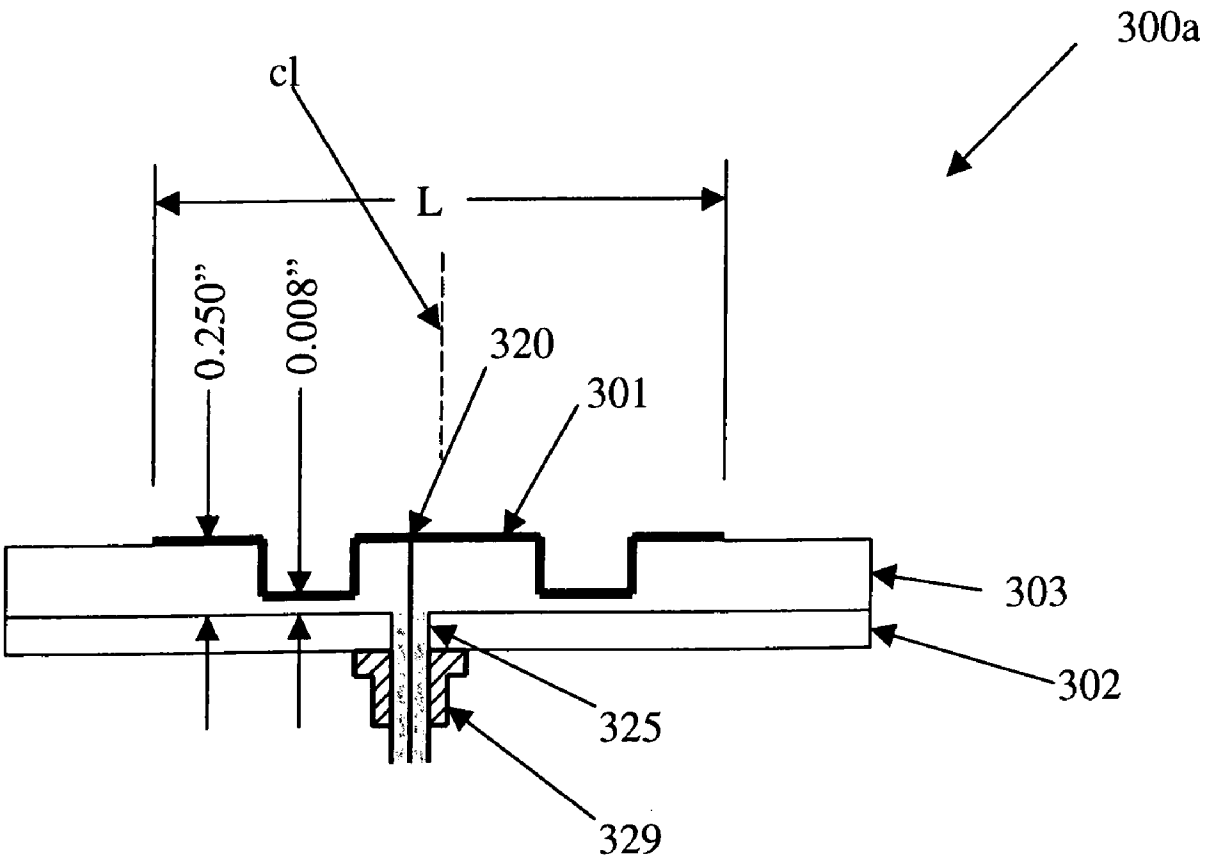
FIGS. 3*a*–3*d* illustrate microstrip antennas in accordance with one or more aspects of the present invention.

Turning now to FIG. 3*a*, illustrated is an edge view of a microstrip antenna 300*a* with discontinuous separation distance of a conductive radiating strip from a ground plane, constructed according to principles of the present invention. The microstrip antenna 300*a* includes a conductive radiating strip 301 in the form of a microstrip line, which has an effective electrical length of about a half wavelength, with abruptly changed separation distance from a ground plane 302. The conductive radiating strip is separated from the conductive ground plane 302 by an insulating substrate 303 with varying thickness such as provided by indentations (e.g., grooves) to accommodate the shape of the conductive radiating strip 301. It is contemplated that different or similar insulating materials may be used for the insulating substrate 303 and the dielectric material for the transmission line with this antenna (or with any of the antennas described hereinbelow). The conductive strip is fed from an RF power source (not shown) by a conductor at a feed point 320 to the radiating microstrip 301 through an aperture 325 in the ground plane and the insulating substrate. As described above with reference to FIG. 2, the feed point 320 is preferably coupled off-center to match the input impedance. A coaxial connector 329 with a flange coupled to the ground plane 302 may be used to provide low-loss coupling to the fed point 320. Although the antenna 300*a* includes a coaxial transmission line coupled to the radiating element 301 with a coaxial connector 329, it is contemplated that other transmission line types can also be used with this antenna (or with any of the antennas described hereinbelow) such as "microstrip line feed", using any suitable interconnecting arrangement.

As an example of discontinuous separation distance of a radiating strip above a ground plane, separations of 0.008 inch and 0.25 inch are shown on FIG. 3*a*. The smaller separation distance preferably is as thin as possible in view of the requirements of the application, and the larger separation distance preferably is about 0.5% to about 5% of a wavelength. If the larger separation distance is made thicker, the antenna bandwidth is wider and the antenna efficiency is better. These changes in separation distance from the ground plane 302 with a substantial ratio provide roughly proportionate changes in the impedance of the strip line formed by the conducting strip 301 and the ground plane 302. The antennas contemplated herein may include abrupt and/or more gradual changes in the separation distance of a radiating element and/or the separation distance of any additional conductive element that may be included in the design to alter a radiation field or other operating characteristic.

As indicated above, characteristic impedance of a strip line varies proportionately as the separation distance of the strip line from the ground plane. Thus, substantial changes in characteristic impedance are able to be achieved without introducing long conducting paths with opposing and canceling radiated fields and incurring significant power loss. The result is a microstrip antenna with an overall length L that can be substantially shorter than the length of a microstrip antenna constructed with a uniform separation distance from a ground plane, but without compromises in antenna performance. Including two or more changes in separation distance from the ground plane, the length L can practically be less than one quarter that of a microstrip antenna configured without changes in separation distance.

Figure 3B:
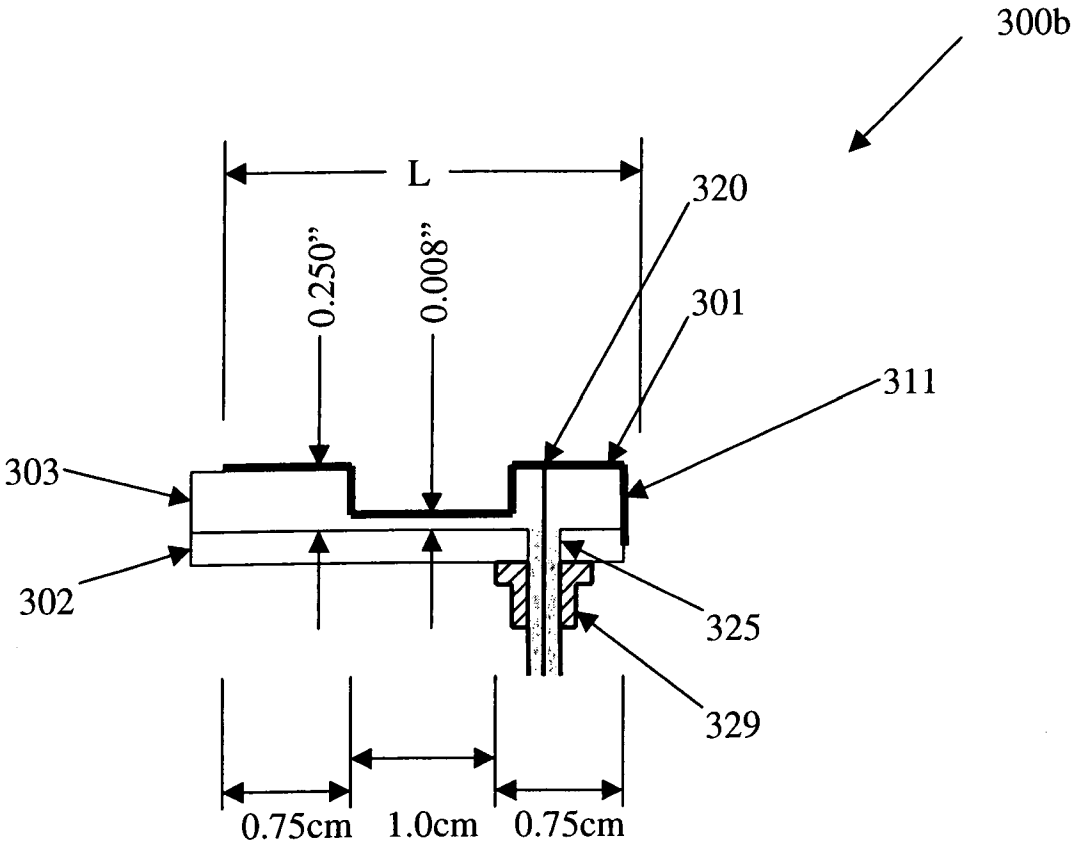

Turning now to FIG. 3*b*, illustrated is an edge view of a microstrip antenna 300*b*, which has an effective electrical length of about a quarter wavelength, with discontinuous separation distance of a conductive radiating strip 301 from a ground plane 302, constructed according to principles of the present invention. Elements of the antenna on FIG. 3*b* that are similar to elements on FIG. 3*a* will not be discussed. The conductive radiating strip illustrated on FIG. 3*a* has an effective electrical length of about a half wavelength and is shown with both ends open. The conductive radiating strip 301 illustrated on FIG. 3*b* has an effective electrical length of about a quarter wavelength and has one end open and one end shorted to the ground plane 302 with shorting strip 311.

For the two-step, quarter wavelength microstrip design illustrated on FIG. 3*b*, microstrip section lengths of about 0.75 cm., 1 cm., and 0.75 cm. (for a total microstrip length of 2.5 cm.) result in an electrical resonant frequency of about 700 MHz when the dielectric material has a permittivity of about 1.0. The resonant (quarter wavelength) length of a microstrip line antenna without changes in separation distance at this frequency is about 10.5 cm. The gain of this antenna in a preferred direction was measured to be about 0 dBi, i.e., 0 dB greater than a reference isotropic radiator.

Figure 3C:
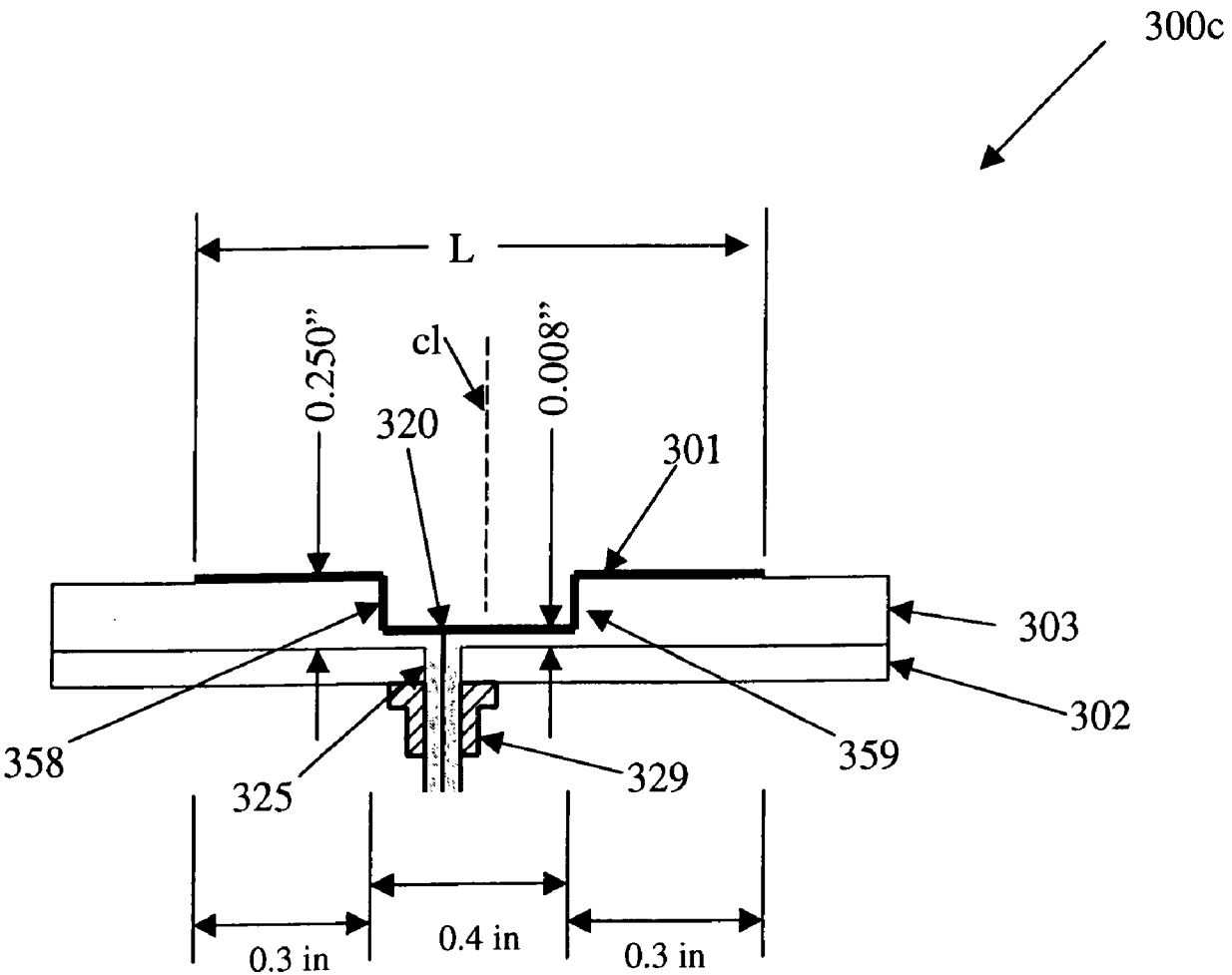

Turning now to FIG. 3*c*, illustrated is an edge view of a microstrip antenna 300*c* with discontinuous separation distance of a conductive radiating strip 301 from a ground plane 302, constructed according to principles of the present invention. The embodiment of FIG. 3*c* (and of FIG. 3*d* as described below) has an advantage over the embodiments of FIGS. 3*a* and 3*b* in that it will have a higher efficiency, although at the expense of size. This embodiment might be useful in applications where size is less critical, e.g., with RF tags used to track large items.

Elements of the antenna on FIG. 3*c* that are similar to elements on FIG. 3*a* will not be discussed. The conductive radiating strip 301 in this illustrative example has an effective electrical length of about a half wavelength, and is shown with two changes in separation distance from the ground plane at locations 358 and 359. In this example, the feed point 320 is at a small separation distance from the ground plane, and the ends of the conductive radiating strip 301 are at a large separation distance. The location of the feed point 320 is preferably offset from the center of the radiating strip 301 as previously discussed to provide the necessary feed-point impedance to match that of the RF power source. A coaxial connector 329 with a flange coupled to the ground plane 302 may be used to provide low-loss coupling to the feed point 320.

The microstrip line 301 and the ground plane 302 are preferably fabricated of a material such as copper, aluminum, silver, or other material or alloy with suitably good conductive properties, with a conductive material thickness typically on the order of 1 mil. The insulating substrate 303 is preferably fabricated of a mechanically stable dielectric but preferably with a low relative dielectric constant near 1.0 such as foam, e.g., such as Rohacell 51HF, available from Richmond Aircraft Products, 13503 Pumice St., Norwalk, Calif. Using a dielectric material with a high dielectric constant reduces the antenna size further but results in an antenna with lower efficiency. General manufacturing techniques including additive and subtractive lithographic processes for forming multi-layer structures of conductive and insulating materials are well known in the art and will not be described in the interest of brevity.

Figure 3D:
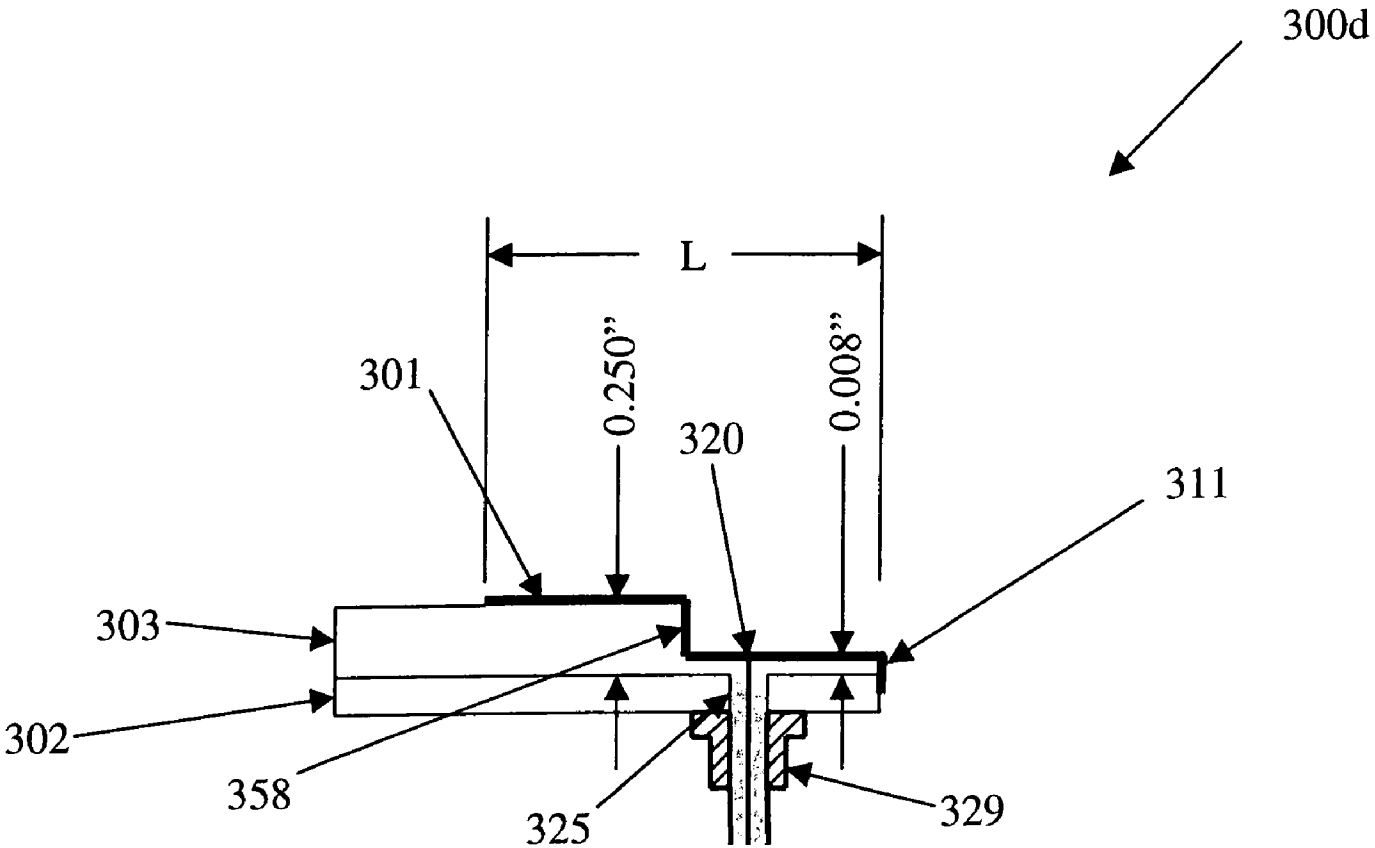

Turning now to FIG. 3*d*, illustrated is an edge view of a microstrip antenna 300*d* with changes in separation distance above a ground plane, constructed according to principles of the present invention. The conductive radiating strip 301 illustrated on FIG. 3*d* has an effective electrical length of about a quarter wavelength and has one end open and one end shorted to the ground plane 302 with shorting strip 311. The remaining elements of the antenna on FIG. 3*d* that are similar to elements on FIG. 3*c* will not be discussed in the interest of brevity.

Figure 4A:
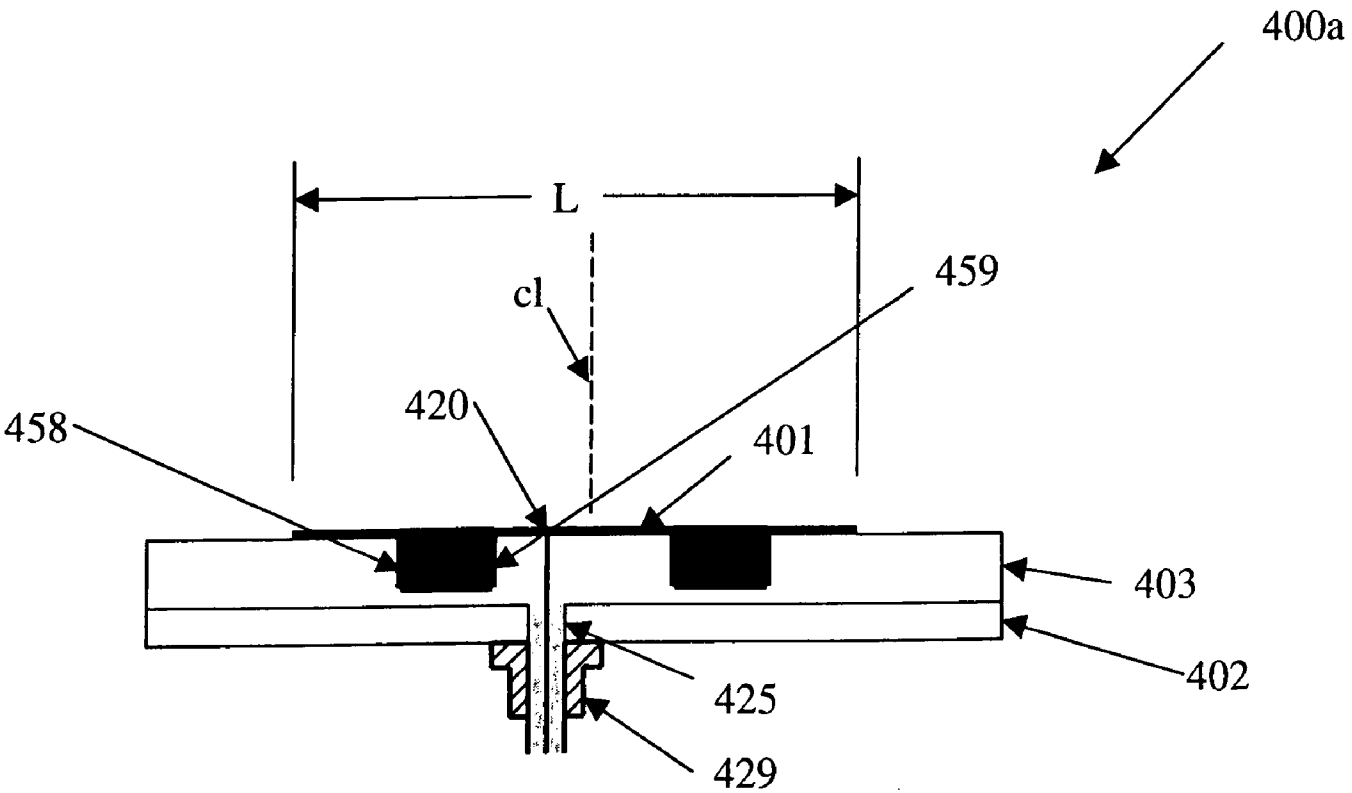
FIGS. 4*a*–4*c* illustrate microstrip antennas in accordance with one or more aspects of the present invention.

Turning now to FIG. 4*a*, illustrated is an edge view of a microstrip antenna 400*a* with changes in separation distance such as 458 and 459 above a ground plane 402, constructed according to principles of the present invention. Unlike the microstrip antenna illustrated on FIG. 3*a* the antenna illustrated on FIG. 4*a* has an even top surface 401, which may have advantages in manufacturing an end product. In this case, any useful and appropriate material for fabrication convenience can be used to fill the cavities. The other elements illustrated on FIG. 4*a* correspond to similar elements shown on FIG. 3*a* and will not be discussed in the interest of brevity, and the electrical performance of the antenna illustrated on FIG. 4*a* is substantially similar to that for the antenna illustrated on FIG. 3*a*. This fill modification can be made to any of the embodiments disclosed herein.

Figure 4B:
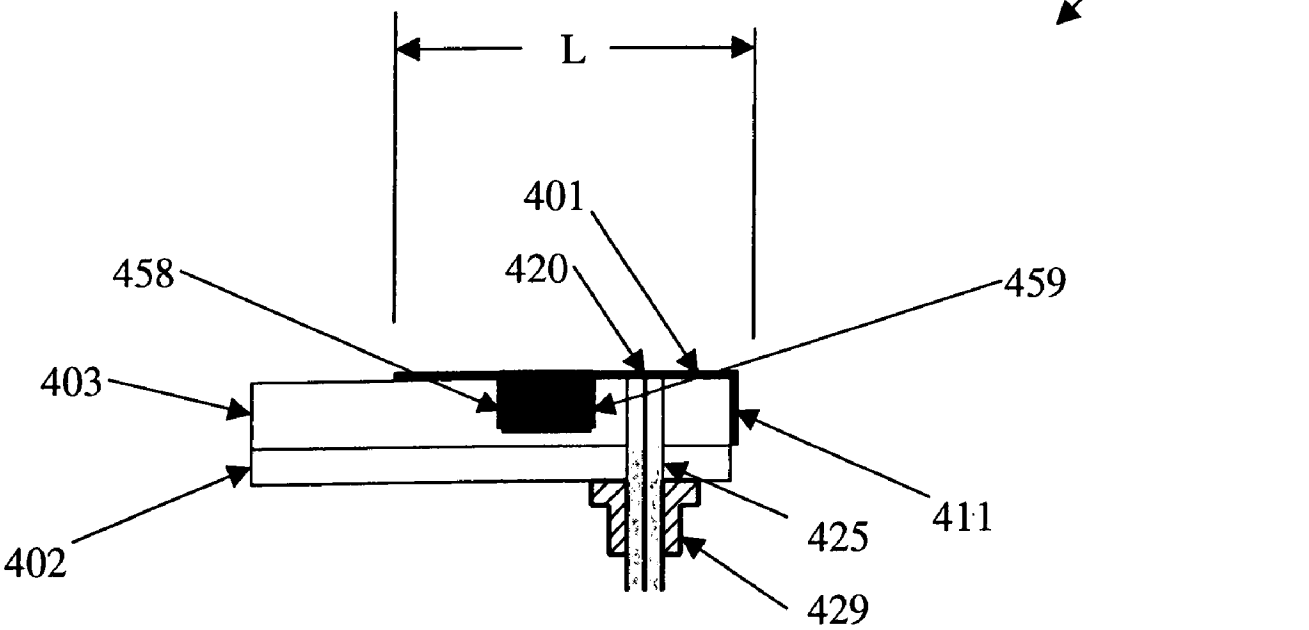

Turning now to FIG. 4*b*, illustrated is an edge view of a microstrip antenna 400*b* with changes 458 and 459 in separation distance above a ground plane 402, with an even top surface 401, constructed according to principles of the present invention. The effective electrical length of the microstrip antenna 400*b* is about a quarter wavelength. The shorting strip 411 shorts the right end of the microstrip antenna 401 to the ground plane 402. The other elements illustrated on FIG. 4*b* correspond to similar elements shown on FIG. 4*a* and will not be discussed in the interest of brevity.

Figure 4C:
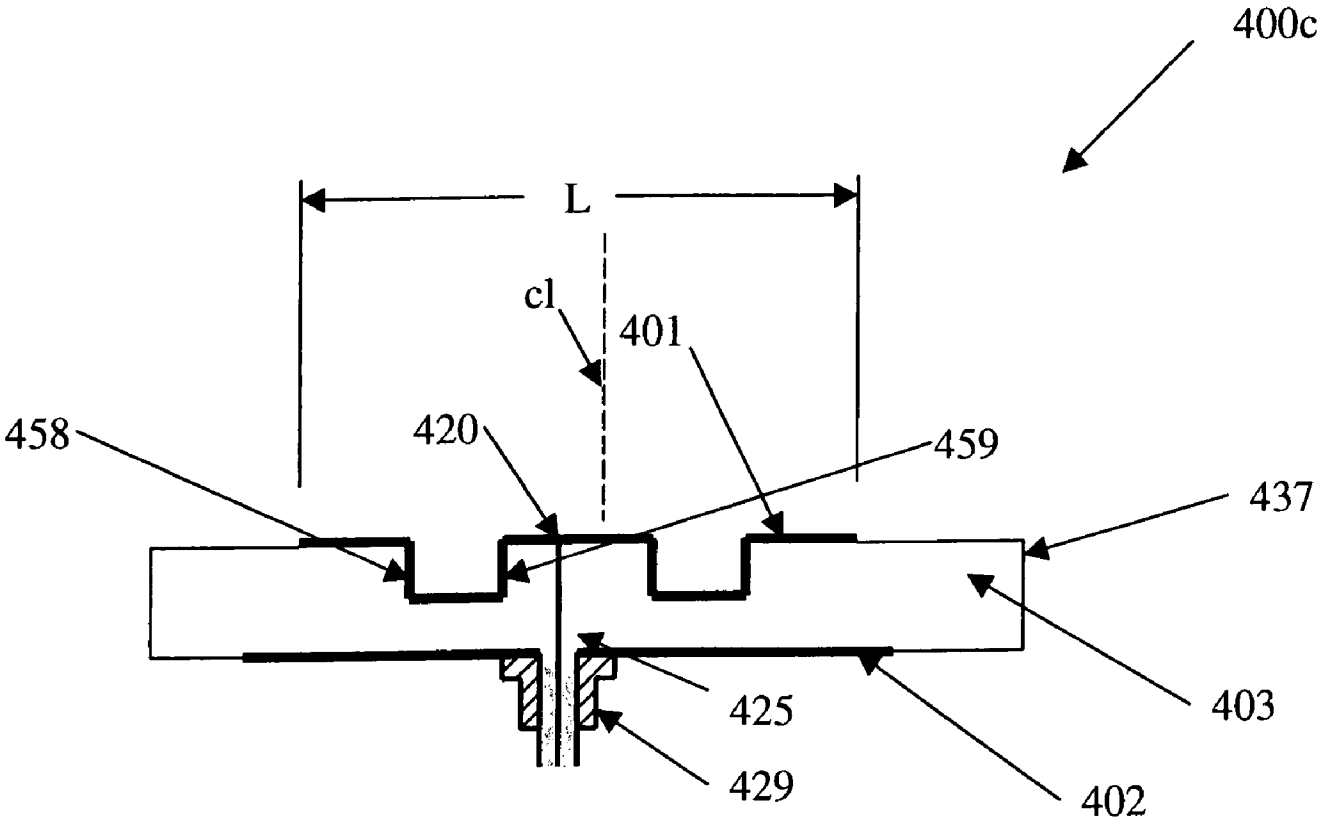

Turning now to FIG. 4*c*, illustrated is an edge view of a microstrip antenna 400*c* configured with an electromagnetically transparent enclosure 437 such as a plastic or other dielectric material, on whose internal or external surfaces are disposed the conductive elements of the antenna, constructed according to principles of the present invention. Preferably the enclosure is hermetically sealed to prevent ingress of water vapor and other contaminants. The container may contain a solid dielectric material such as Teflon or other suitable insulator, or it may contain a dielectric foam, or a gas such as dry nitrogen, or even a vacuum. The other elements illustrated on FIG. 4*c* correspond to similar elements shown on FIG. 4*a* and will not be discussed in the interest of brevity. Any of the other antenna configurations illustrated herein may also be configured with an electromagnetically transparent enclosure.

Figure 5A:
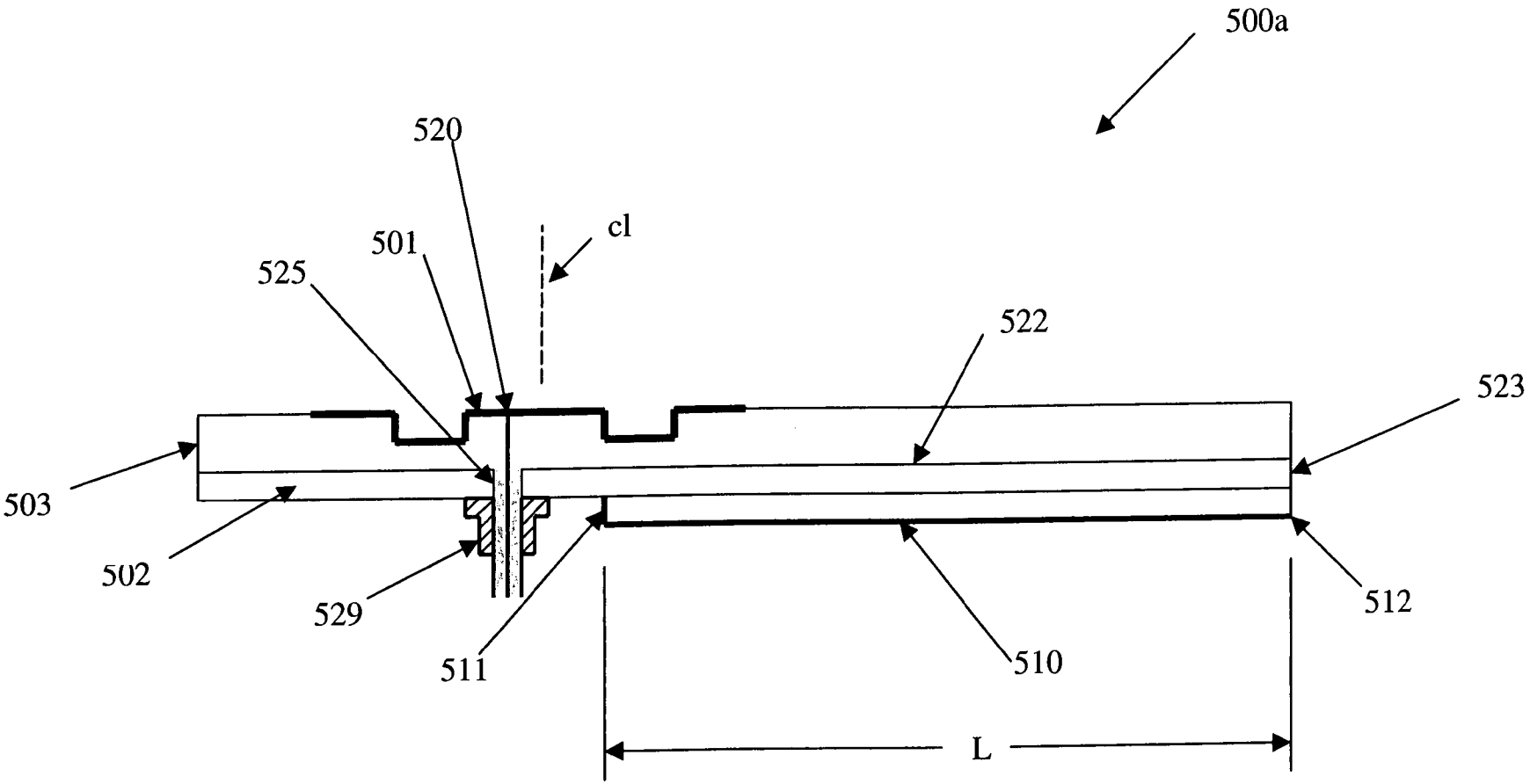
FIGS. 5*a* and 5*b* illustrate microstrip antennas with a second conductive strip configured to reduce currents on the second side of the ground plane in accordance with one or more aspects of the present invention.

Turning now to FIG. 5*a*, illustrated is an edge view of a microstrip antenna 500*a* with changes in separation distance above a ground plane, constructed according to principles of the present invention. The microstrip antenna includes a second conductive strip 510 formed as a microstrip line on the backside of the ground plane 502 with its left end 511 shorted to the ground plane and its right end 512 electrically open and proximate the edge 523 of the ground plane. The length L of the second conductive strip 510 is preferably configured to be about a quarter of a wavelength for the signal to be transmitted, but odd multiples of about a quarter wavelength can also be used.

The second conductive strip is operative as a quarter wavelength transformer, providing very large impedance at the open end. Thus, when a finite voltage is applied at the open end, the current that flows is very small.

Currents ordinarily conducted around the right edge 523 encounter an open circuit at the frequency of the signal to be transmitted, and are reflected back onto the top side 522 of the ground plane 502. These currents beneficially do not appear on the backside of the assembly, and thereby do not contribute to near-field electromagnetic radiation that might otherwise be coupled to a person's head. Similarly, a third conductive strip can be located at another edge of the ground plane 502 to reflect currents ordinarily flowing toward that another edge. The current-reflecting operation of the second or third conductive strip does not depend on the discontinuous separation distance property of the conductive radiating strip 501, and can thus also be used with an ordinary microstrip antenna constructed without changes in separation distance from a ground plane. However, the length of a conductive strip without changes in separation distance will be substantially longer than one with changes.

Figure 5B:
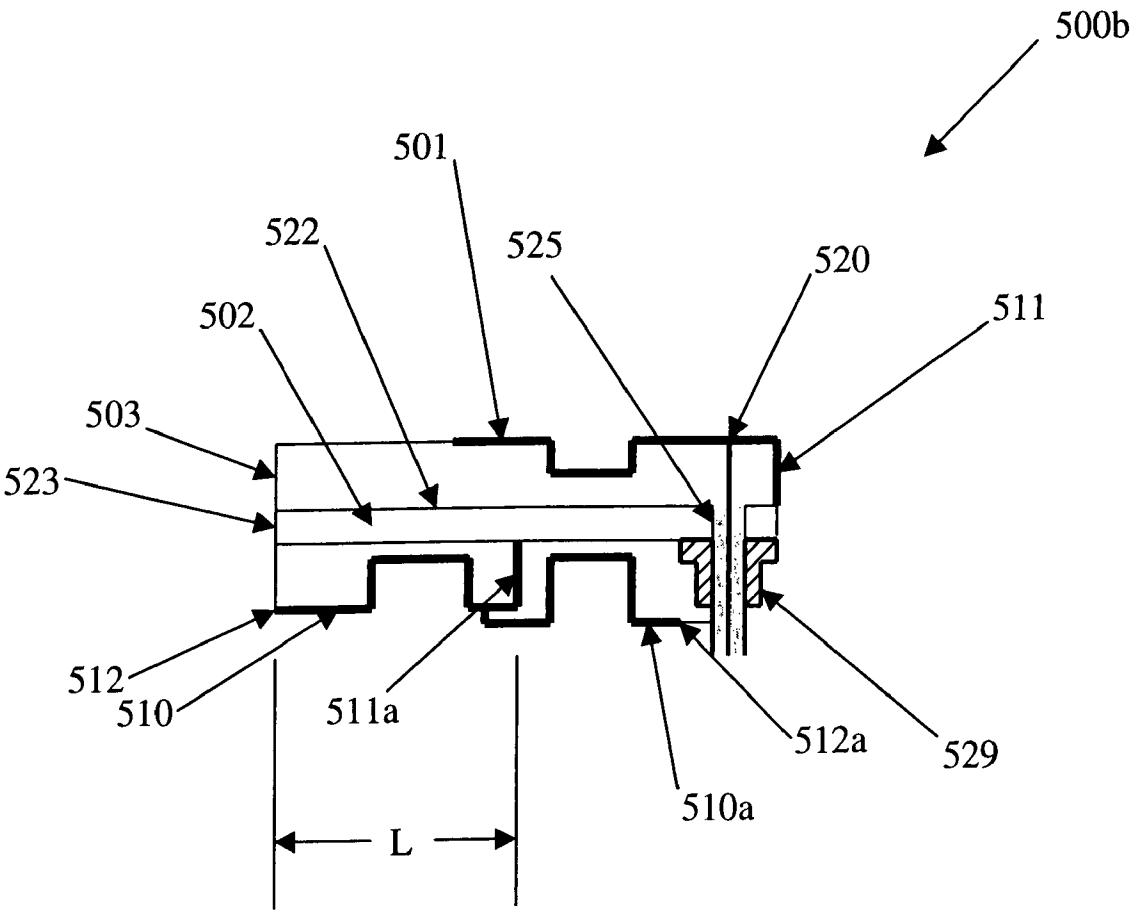

Turning now to FIG. 5*b*, illustrated is an edge view of a microstrip antenna 500*b* with changes in separation distance above a ground plane, and a shorting strip 511 shorting the right end of the radiating strip 501 to the ground plane 502, constructed according to principles of the present invention. The microstrip antenna 500*b*, which has an effective electrical length of about a quarter wavelength, includes a second conductive strip 510 configured as a microstrip line on the backside of the ground plane 502 with one end 511*a* shorted to the ground plane and its other end 512 electrically open and proximate the edge 523 of the ground plane. In addition a third conductive strip 510*a* is configured as a microstrip line on the backside of the ground plane 502 with one end coupled near the shorted end of the second conductive strip 510 and its other end 512*a* electrically open. Both conductive strips 510 and 510*a* are operative to obstruct flow of RF currents on the backside of the ground plane 502.

Figure 6A:
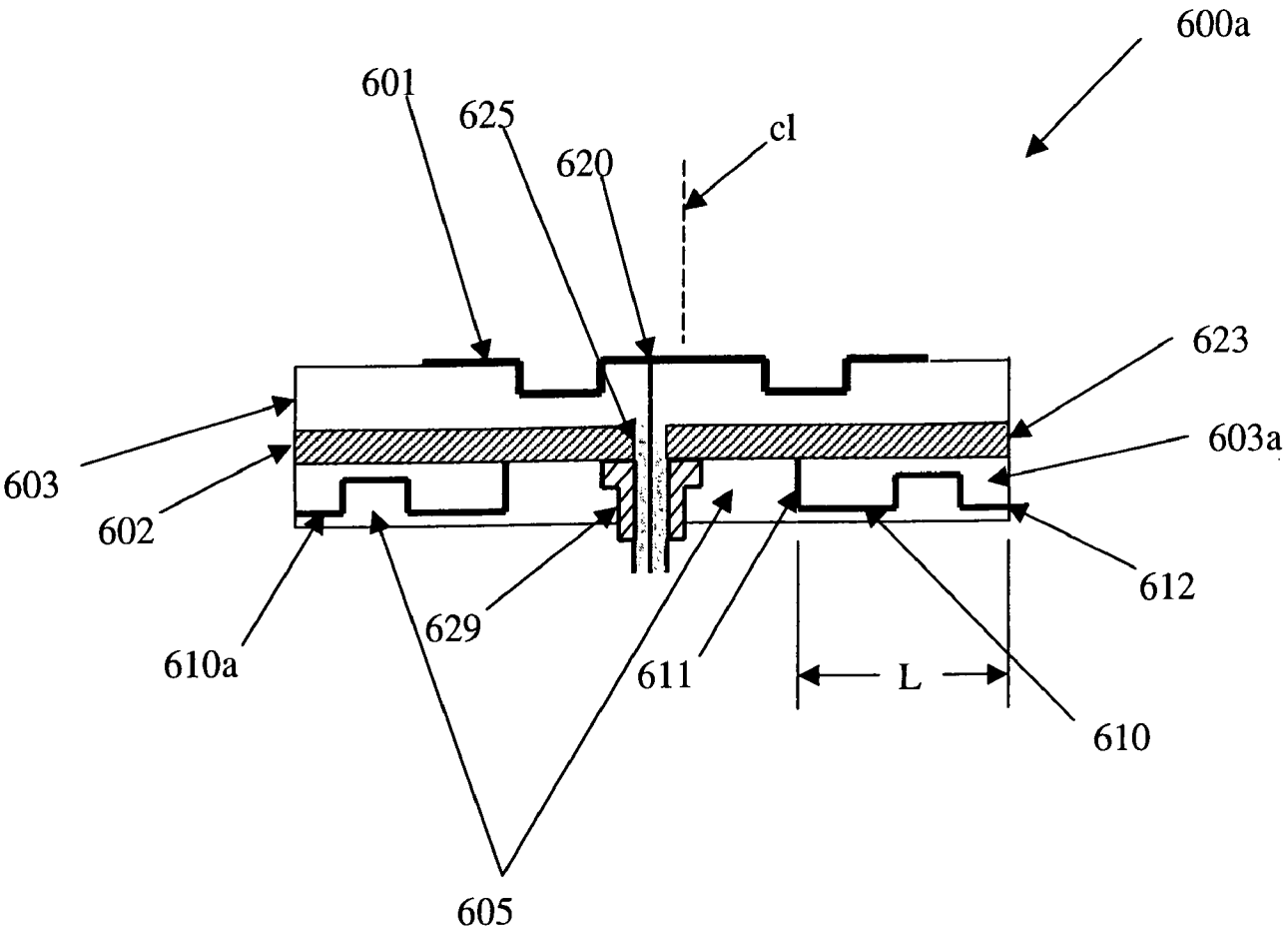
FIG. 6*a* illustrates a microstrip antenna with second and third conductive strips configured to reduce currents on the second side of the ground plane in accordance with one or more aspects of the present invention.

Turning now to FIG. 6*a*, illustrated is an edge view of a microstrip antenna 600*a* with changes in separation distance from a ground plane, constructed according to principles of the present invention. The microstrip antenna includes second and third conductive strips 610 and 610*a*, each with an effective electrical length of about a quarter wavelength on the second side of the ground plane 602 with one end, e.g., 611 shorted to the ground plane and its other end, e.g., 612 electrically open as described with reference to FIG. 5*a* and proximate an edge, e.g., 623 of the ground plane 602. The second and third conductive strips 610 and 610*a* are separated from the ground plane 602 by an insulating substrate, e.g., 603*a*.

The second conductive strip 610 is configured with changes in separation distance from the second side of the ground plane 602. The resulting changes in impedance of this strip line produce an effective electrical length that is substantially longer than its physical length. Thus the second conductive strip 610 can be configured as a quarter wavelength transmission line with a length L that may be substantially shorter than a conductive strip with uniform separation distance from a ground plane 602, creating thereby an open circuit that can reflect RF currents ordinarily conducted around the right edge 623 of the of the ground plane 602 back onto the first side of the ground plane.

The RF current-reflecting property of the second conductive strip 610 does not depend on the discontinuous separation property of the conductive radiating strip 601, and can thus also be used with an ordinary microstrip antenna without changes in separation distance. In addition, a third conductive strip with changes in separation distance from the second side of the ground plane 602 can be located on another edge of the ground plane to reflect currents ordinarily flowing toward that another edge.

FIG. 6*a* also illustrates a lossy magnetic layer 605 applied over the second side of the ground plane 602. The lossy magnetic layer may cover all or portions of the second side of the ground plane and all or portions of a conductive strip operative to reflect currents back onto the first side of the ground plane. The lossy magnetic layer provides a mechanism to absorb near field radiation that might be induced on the backside of the ground plane with only nominal effect on the radiated far field. Thus SAR can be further reduced without substantially affecting the principal radiation characteristics of the antenna. Preferred exemplary materials with absorptive properties at frequencies used for cellular communication are lossy ferrite materials. Desirable properties of a lossy magnetic material are a large imaginary component of permeability at the transmitting frequency so as to provide an absorptive near-field loss mechanism, and low electrical conductivity. While illustrated exemplary with respect to the embodiment of FIG. 6*a*, it is understood that the lossy magnetic layer 605 can be utilized with any of the embodiments described herein.

Figure 6B:
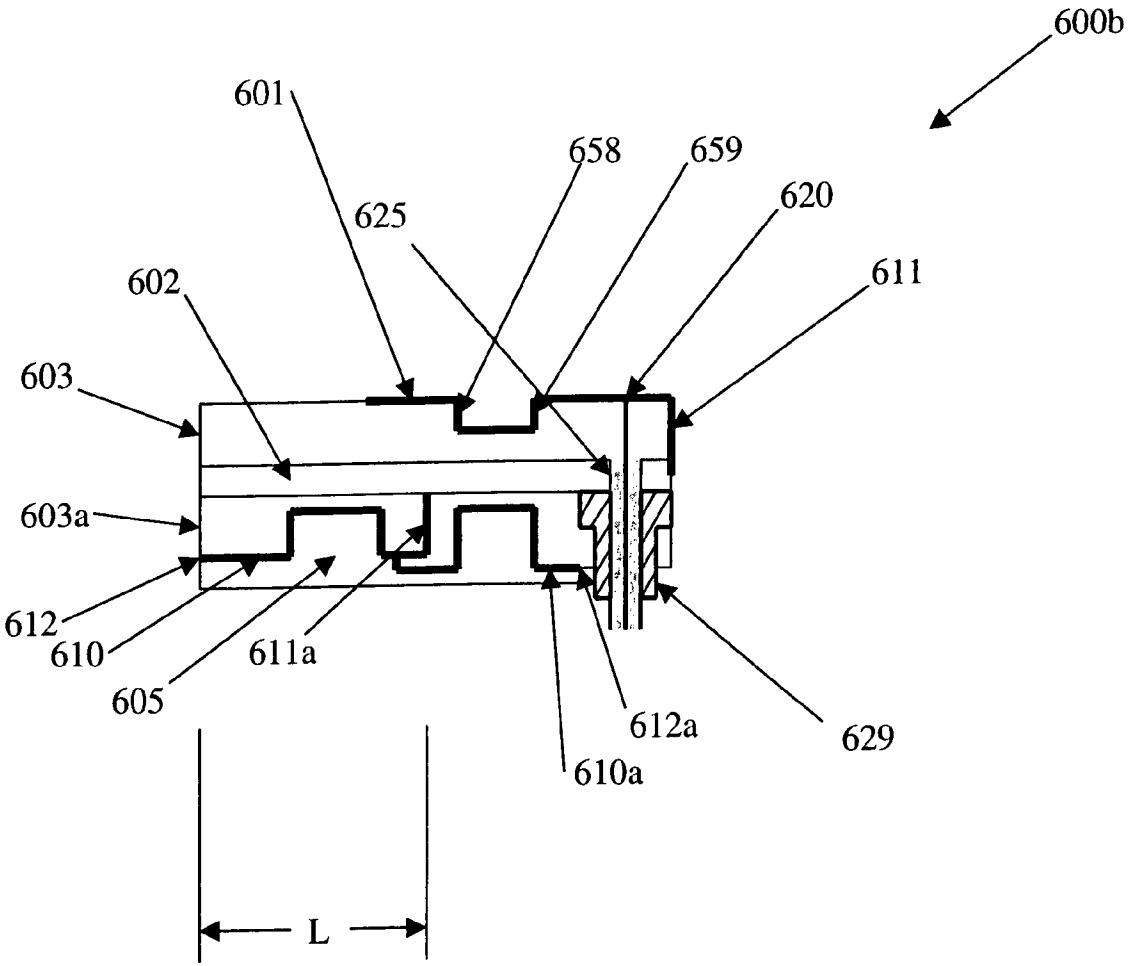
FIG. 6*b* illustrates a microstrip antenna with a second conductive strip on the second side of a ground plane configured to reduce currents in accordance with one or more aspects of the present invention.

FIG. 6*b* illustrates an edge view of a microstrip antenna 600*b* with discontinuous separation distance of a conductive radiating strip 601 from a ground plane, constructed according to principles of the present invention. The microstrip antenna 600*b*, which has an effective electrical length of about a quarter wavelength, includes a conductive radiating strip 601 in the form of a microstrip line with two abrupt changes in separation distance 658 and 659 from a ground plane 602. The conductive radiating strip 601 is separated from the conductive ground plane 602 by an insulating substrate 603 with varying thickness such as would be provided by indentations (e.g., grooves) to accommodate the changes in separation distance of the conductive radiating strip 601. The conductive strip is fed from an RF power source (not shown) by a conductor at a feed point 620 through an aperture 625 in the ground plane preferably using a coaxial connector 629 with a flange coupled to the ground plane. The changes in separation distance from the ground plane permit the microstrip antenna to be constructed with an overall length L that can be substantially shorter than the length of a microstrip antenna constructed with a uniform separation distance from a ground plane, but without compromises in, and even improving on, antenna performance. Including the two changes 658 and 659 in separation distance from the ground plane, the length L can practically be less than one quarter that of a microstrip antenna configured without changes in separation distance.

The microstrip antenna 600*b* includes second and a third conductive strips 610 and 610*a* on the second side of the ground plane 602, separated from the conductive ground plane 602 by insulating substrate 603*a* with one end of conductive strip 610 shorted to the ground plane with short 611*a*, and the other end of each (612 and 612*a*, respectively) electrically open as described with reference to FIG. 5*b*. The second and third conductive strips 610 and 610*a* are preferably configured as quarter wavelength transmission lines. The current-reflecting operation of the second and third conductive strips 610 and 610*a* do not depend on the discontinuous separation property of the conductive radiating strip 601, and could be used with an ordinary microstrip antenna without changes in separation distance. The second and third conductive strips obstruct RF currents from flowing onto the backside of the ground plane and thereby substantially reduce near-field radiation above the second side (backside) of the ground plane, i.e., on the side opposite the microstrip antenna. The microstrip antenna 600*b* preferably includes a lossy magnetic material 605 to further absorb near-field radiated energy on the backside of the ground plane.

Figure 6C:
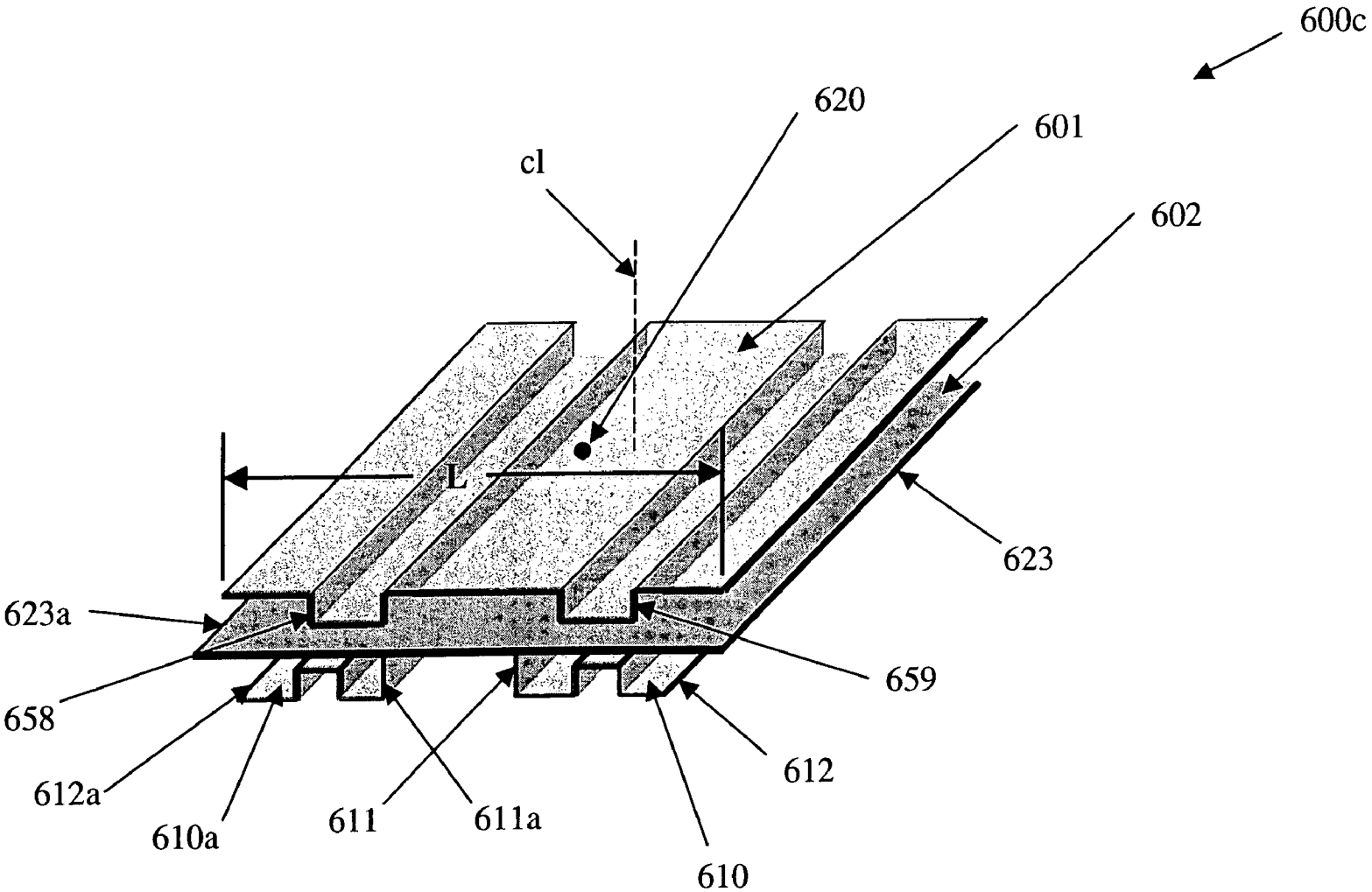
FIG. 6*c* illustrates a microstrip antenna with second and third conductive strips on the second side of a ground plane configured to reduce currents in accordance with one or more aspects of the present invention.

Turning now to FIG. 6*c*, illustrated is a three-dimensional view of a microstrip antenna 600*c* with changes in separation distance from a ground plane, constructed according to principles of the present invention. The microstrip antenna, which has an effective electrical length of a half wavelength, includes a second conductive strip 610 on the second side of the ground plane 602 with its left end 611 shorted to the ground plane and its right end 612 electrically open as described with reference to FIG. 5*a* and proximate the edge 623 of the ground plane 602. In addition, a third conductive strip 610*a* is included on the second side of the ground plane 602 with its right end 611*a* shorted to the ground plane and its left end 612*a* electrically open. Both conductive strips 612 and 612*a* preferably include changes in separation distance from the ground plane, e.g., 658 and 659, as described with respect to the antennas illustrated hereinabove. The feed point 620 is offset from the center of the radiating strip 601 to provide the necessary feed-point impedance to match that of an RF power source. The center of the radiating strip 601 is illustrated with the dashed line cl. A coaxial connector (not shown) with a flange coupled to the ground plane 602 may be used to provide low-loss coupling to the feed point 620 through an aperture in the ground plane.

Figure 6D:
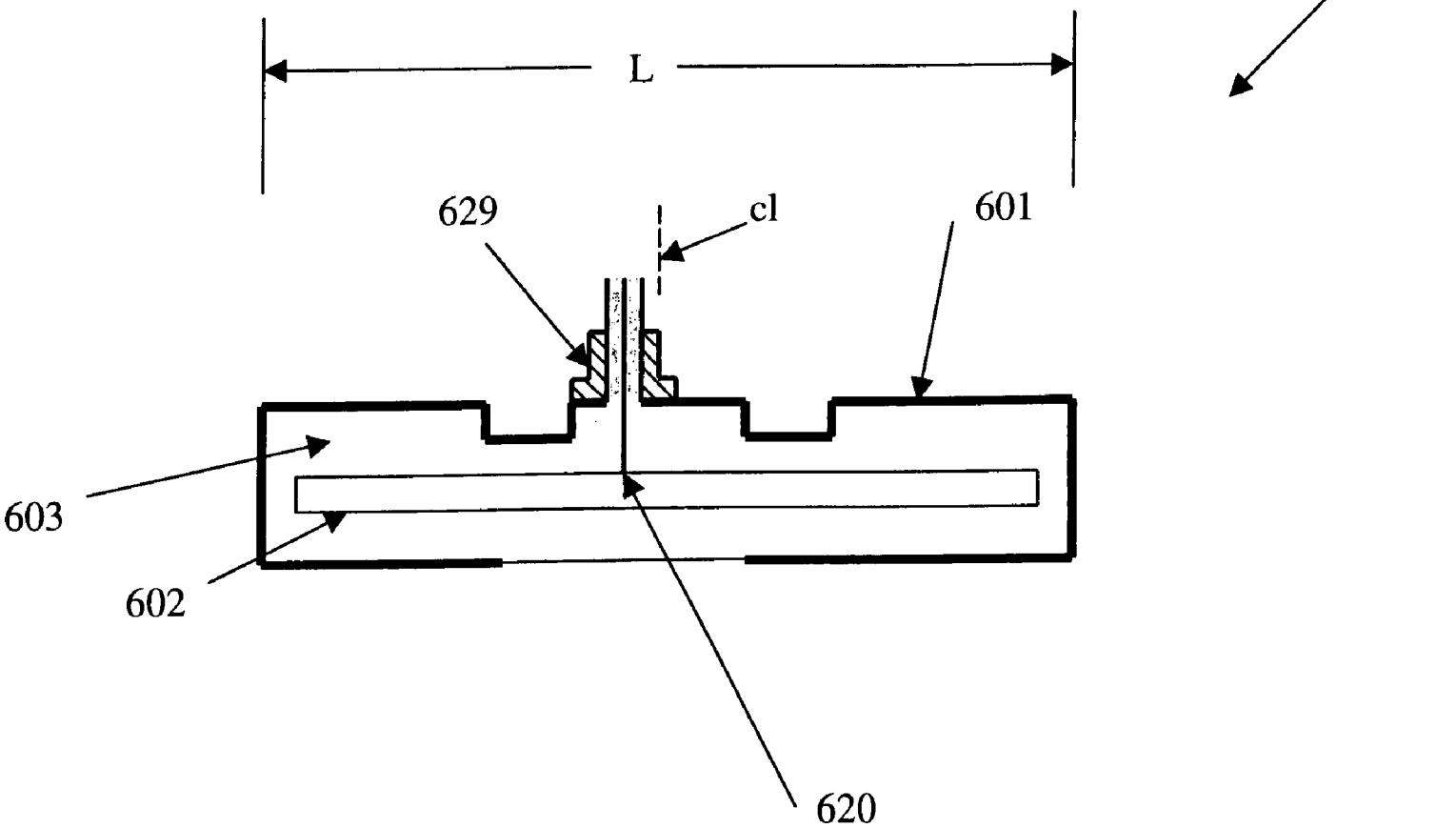
FIG. 6*d* illustrates a microstrip antenna in accordance with one or more aspects of the present invention.

Turning now to FIG. 6*d*, illustrated is an edge view of a microstrip antenna 600*d* with changes in separation distance from a ground plane 602, constructed according to principles of the present invention. The radiating conductive strip 601, which has an effective electrical length of a half wavelength, extends beyond the edges of the ground plane 602 and continues over the backside of the ground plane. In this manner, the length L can be further reduced as well as reducing the size of the ground plane. The radiating strip preferably is fed from an off-center fed point 620 to provide the necessary feed-point impedance match. The feed point preferably is coupled to an RF power source using a coaxial connector as illustrated, or, as previously indicated, any other feeding method such as a stripline feed. In the configuration illustrated on FIG. 6*d*, the shield of the coaxial cable is coupled to the radiating strip, and the center conductor of the coaxial cable is coupled to the ground plane 602.

Figure 6E:
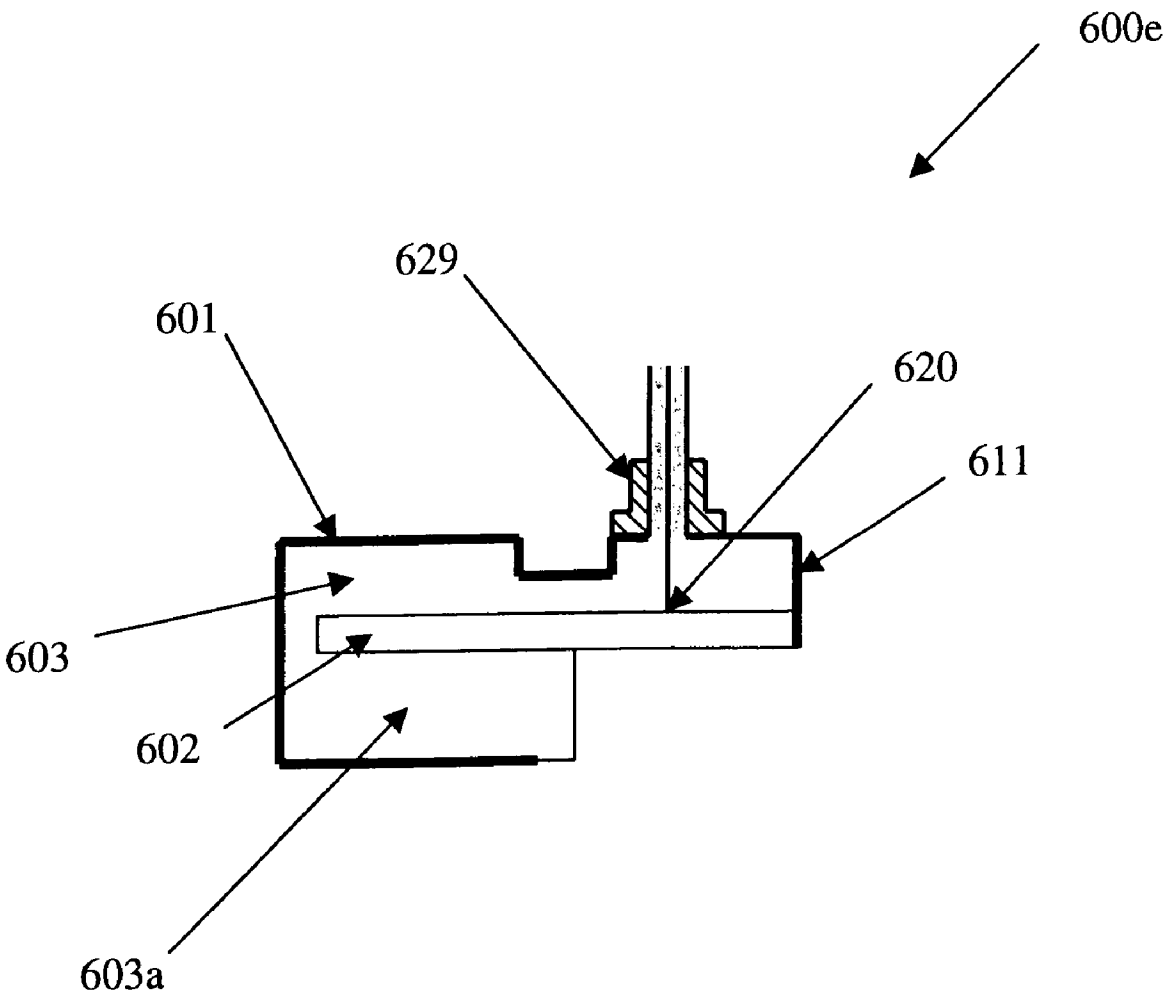
FIG. 6*e* illustrates a microstrip antenna in accordance with one or more aspects of the present invention.

Turning now to FIG. 6*e*, illustrated is an edge view of a quarter wavelength microstrip antenna 600*e* with changes in separation distance from a ground plane 602, constructed according to principles of the present invention. The radiating conductive strip 601, which has an effective electrical length of a quarter wavelength, extends beyond the edges of the ground plane 602 and continues onto the backside of the ground plane in the manner described with respect to FIG. 6*d*, above. In this manner, the length L of this quarter wavelength antenna can also be further reduced. The thickness of the insulating substrate 603*a* on the backside of the ground plane 602 is shown larger than the thickness of the insulating substrate 603 on the top side of the ground plane so as to improve bandwidth and efficiency, which can be employed with other antenna configurations described herein. Again, as previously illustrated on FIG. 6*d*, the shield of the coaxial cable is coupled to the radiating strip, and the center conductor of the coaxial cable is coupled to the ground plane 602.

Figure 6F:
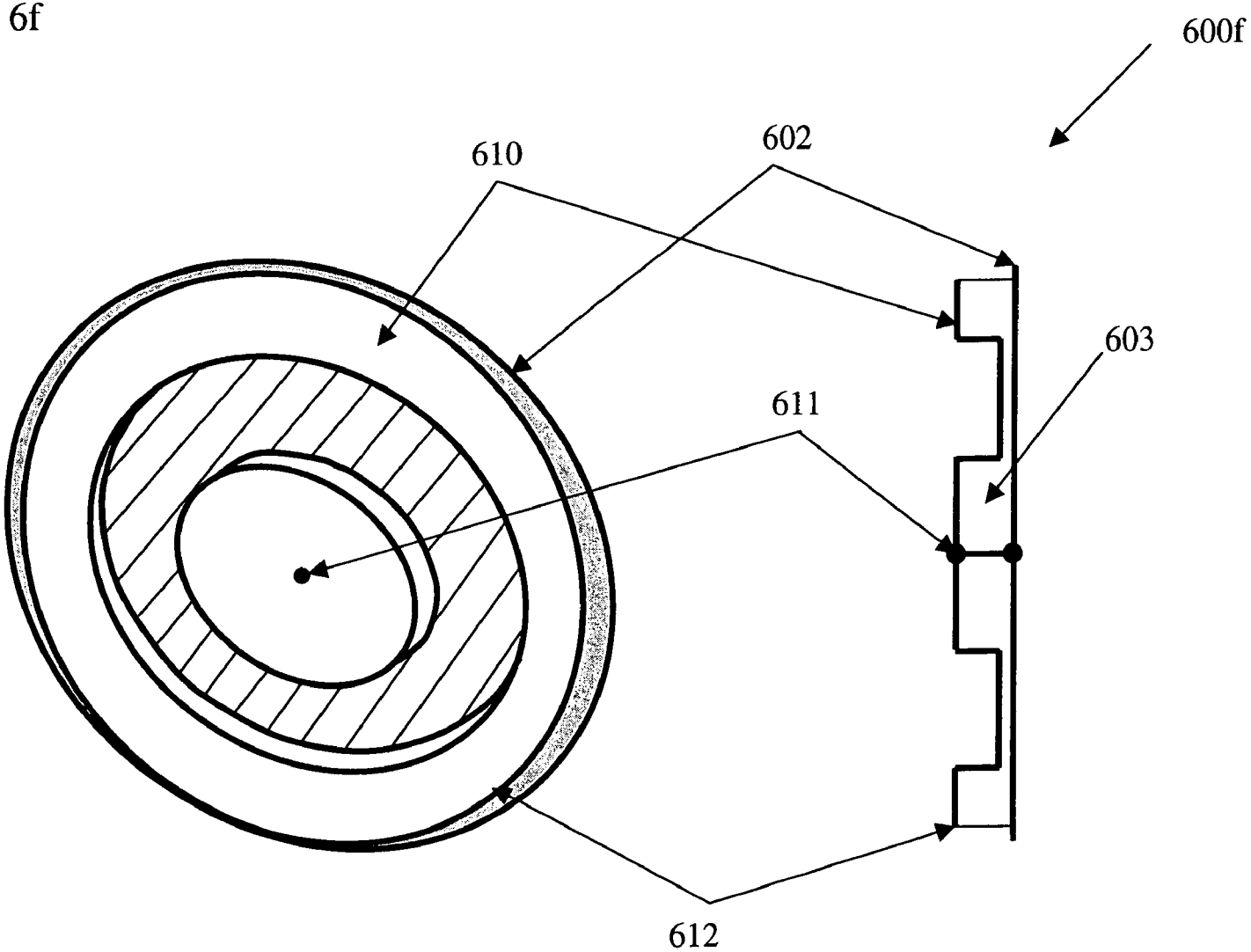
FIG. 6*f* illustrates a three-dimensional and an edge view of a circular conductive strip configured to reduce currents on the second side of the ground plane in accordance with one or more aspects of the present invention.

Turning now to FIG. 6*f*, illustrated is three-dimensional view and an end view 600*f* of a conductive strip 610 above a second side (backside) of a ground plane 602 constructed according to principles of the present invention. The conductive strip 610 is configured with a curved outer end 612 proximate the outer edge of the ground plane 602 and separated from the ground plane by an insulating medium 603. The conductive strip is further configured with changes in separation distance from the ground plane 602. The central point 611 of the conductive strip is shorted to the ground plane with a conducting pin. The conductive strip can thus be configured as a quarter wavelength cylindrical transmission line. The current-obstructing effect of a quarter wavelength transmission line with one end shorted and one end open is described hereinabove, e.g., with reference to FIGS. 5*a* and 6*a*. This produces a high impedance for RF current that might flow over the curved outer edge of the ground plane onto the backside as might be induced by an antenna on the opposing side. The resultant radiation properties are similar to those of a dipole antenna. In this manner the troublesome near-field radiation likely to be exposed to a person's head when using a cellular telephone can be substantially reduced. If the conductive strip is fed off-center, the $TM_{11}$ mode can be excited to obtain a radiation pattern similar to that of a half wavelength rectangular microstrip antenna.

The antenna of various embodiments can be used in a large number of applications. One example is an RF tag, such as those used for toll collections, inventory tracking, and the like. Another example is a cellular telephone, which can especially take advantage of the reduced SAR of various ones of the embodiments. An example of a cellular telephone is shown in FIGS. 7 and 8 as described below.

Figure 7:
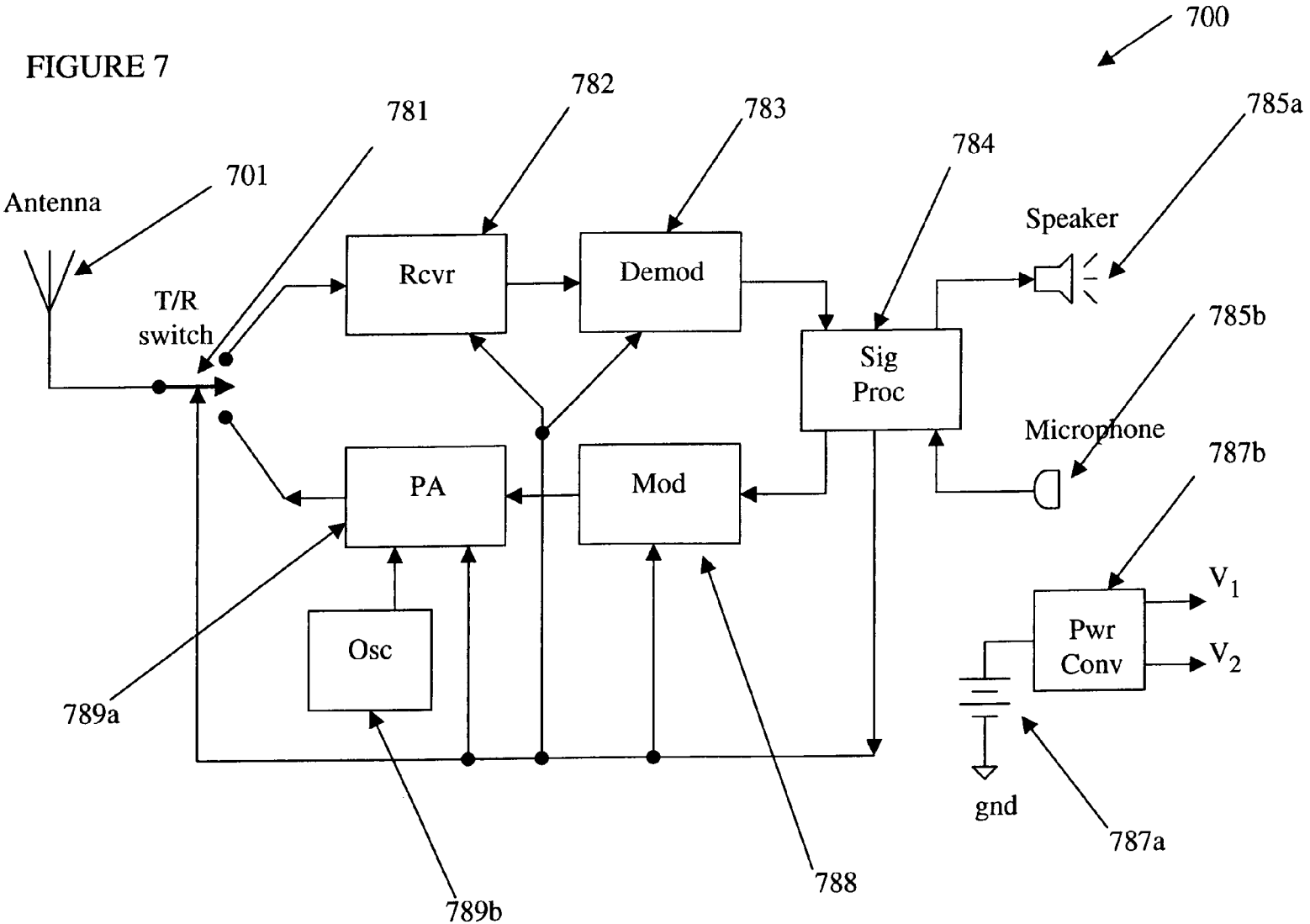
FIG. 7 illustrates a block diagram of a cellular telephone in accordance with one or more aspects of the present invention.
Figure 8:
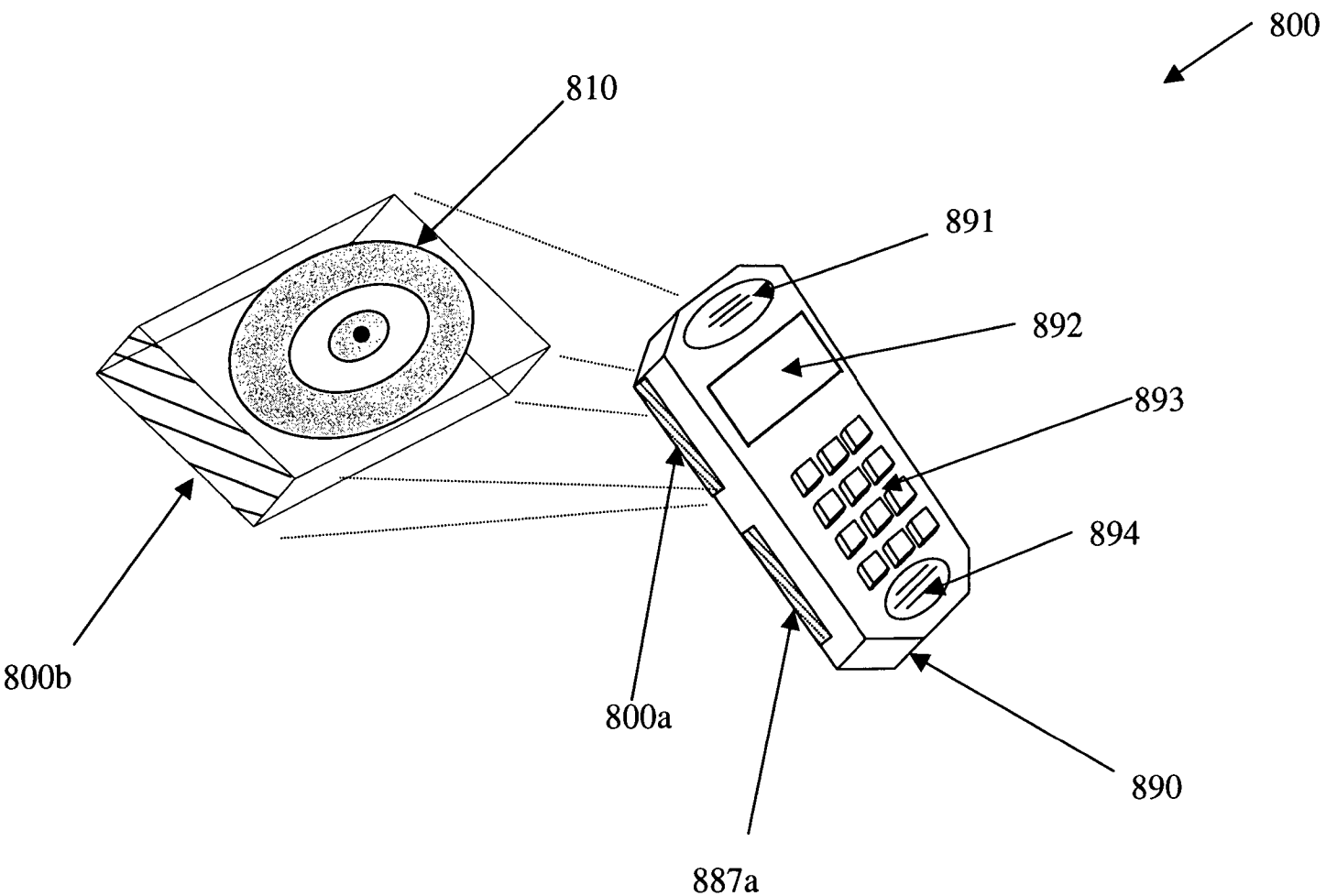
FIG. 8 illustrates a sketch of a cellular telephone set including a circular conductive strip configured to reduce currents on the second side of a ground plane in accordance with one or more aspects of the present invention.

Turning now to FIG. 7, illustrated is a representative block diagram of a cellular telephone set 700 constructed according to principles of the present invention. A cellular telephone set is a device configured to transmit and receive the complex signals necessary to accommodate reliable one-on-one duplex communication in a multi-party, multi-frequency, multi-base station, mobile environment. The blocks shown on FIG. 7 are not arranged in a unique manner, but are representative of essential functions that must be performed.

The antenna 701, however, is a basic function in the design of a cellular telephone set, not only in its being in-line in both the transmitting and receiving paths, but its ability to be implemented in a small size with low SAR is essential to long term and continued widespread use of cellular telephony without concern about possibly subtle or adverse effects on human health. Thus the miniaturization of cellular telephones and the reduction of the near-field radiation pattern on the backside of a ground plane make it an inseparable part of a design.

The remaining parts shown on FIG. 7 are the transmit/receive switch 781 that selectively couples the antenna to the transmitting or receiving path depending on the state of the set. The receiving path includes a receiver block 782 and a demodulator block 783 that include amplification, filtering, frequency shifting, and detection functions necessary to extract audio and other information from an incoming signal. Further signal processing may be performed as necessary by a signal-processing block 784 before the signal is coupled to a loudspeaker 785*a*.

The transmitting path includes a modulator 788, oscillator 789*b*, and a transmitter power amplifier 789*a*. An audio signal is shown generated by a microphone 785*b* coupled to the signal-processing block. Both the transmitting and receiving paths are controlled by the signal-processing block, such as represented by block 784, to provide automatic duplex operation. Power for operation of all functions is provided by a battery 787*a* coupled to a power converter 787*b* that generally supplies multiple output voltages such as $V_1$ and $V_2$ to the various functional portions of the circuit.

It is recognized that a practical implementation of a cellular telephone requires substantial circuit integration such as in silicon, which provides numerous opportunities for complex processing and interconnection among circuit functions. The arrangement on FIG. 7 is intended only to illustrate a general signal flow, and may not represent the design of a specific product.

Turning now to FIG. 8, illustrated is a sketch of a cellular telephone set 800 constructed according to principles of the present invention. The cellular telephone set includes a loudspeaker 891, a microphone 894, a keypad 893, a display, 892 and a battery 887*a*. Controls and other elements such as power and function buttons are omitted from the sketch for simplicity.

The cellular telephone set includes a microstrip antenna 800*a* on the backside of the set, with a conductive strip 810 above a backside of an antenna ground plane (not shown) constructed according to principles of the present invention. The microstrip antenna 800*a* is shown enlarged as 800*b*. A conductive strip 810 is circularly configured as shown on the figure with an outer end that is intended to be proximate an outer edge of the antenna ground plane. The conductive strip 810 can be configured to be operative to obstruct RF current flow on the side of the antenna ground plane facing a person's head, thereby reducing SAR. Thus an integrated design of a cellular telephone set can be accommodated that is compact, efficient, and operable over extended periods of time without concern about absorbed radiation and the possible consequences for a person's health.

Although the present invention has been described in detail and with reference to particular embodiments, those skilled in the art should understand that various changes, substitutions and alterations can be made as well as alterative embodiments of the invention without departing from the spirit and scope of the invention in its broadest form.

What is claimed is:

1. An antenna comprising:

an insulating substrate;

a conductive strip disposed on a first surface of the substrate, the conductive strip having a characteristic impedance that varies along its length;

a ground plane disposed on a second surface of the substrate, the second surface being opposed to the first surface; and a feed point electrically coupled to an intermediate portion of the conductive strip, the conductive strip including a first portion extending along the length of the conductive strip from the feed point and a second portion extending along the length of the conductive strip from the feed point away from the first portion, the first portion having a different length than the second portion;

wherein the conductive strip is separated from the ground plane by a separation distance, the separation distance being changed at at least one location along the length of the conductive strip.

2. The antenna of claim 1 wherein the antenna comprises a microstrip line that produces an electrically resonant frequency of the antenna that is lower than an electrically resonant frequency of a microstrip antenna of the same configuration but with a uniform conductive element separation distance.

3. The antenna of claim 1 wherein said separation distance between the conductive strip and the ground plane is changed at an angle of about 90° at the at least one location.

4. The antenna of claim 1 wherein changes to said separation distance are made at at least two symmetrically configured locations along the conductive strip.

5. The antenna of claim 1 and further comprising a lossy magnetic material disposed aver at least a portion of said ground plane.

6. The antenna of claim 1 and further comprising another conductive element disposed over a side of said ground plane opposing the conductive strip and insulated from said ground plane except at a point.

7. The antenna of claim 6 wherein the another conductive element has an end that is proximate an edge of said ground plane.

8. The antenna of claim 6 and further comprising an insulating material having a varied thickness disposed between the another conductive element and said ground plane.

9. The antenna of claim 8 wherein the thickness of the insulating material disposed between the another conductive element and said ground plane varies abruptly at at least one location.

10. The antenna of claim 6 wherein said ground plane includes a curved edge and said another conductive element includes an end that is proximate said curved edge.

11. The antenna of claim 1 and further comprising at least two conductive elements disposed aver a side of the ground plane opposing the conductive strip, each of said two conductive elements with an end proximate an edge of said ground plane, and each insulated from said ground plane except at a point.

12. The antenna of claim 1 wherein the substrate is farmed from a material with a relative dielectric constant substantially equal to 1.

13. The antenna of claim 1 wherein the substrate comprises a foam substrate.

14. An antenna comprising:

a conductive strip;

a around plane disposed on a second surface of the substrate, the second surface being opposed to the first surface; and a feed point electrically coupled to an intermediate portion of the conductive strip, the conductive strip including a first portion extending from the feed point and a second portion extending from the feed point away from the first portion;

wherein the conductive strip is separated from the ground plane by a separation distance, the separation distance being changed at at least one location along the conductive strip; and wherein the conductive strip is extended over an edge of the ground plane and continued onto the backside of the ground plane.

15. A method of producing an antenna, the method comprising:

providing an insulating substrate;

configuring a conductive strip on a first surface of the substrate, the conductive strip having a characteristic impedance that varies along its length;

configuring a ground plane on a second surface of the substrate, the second surface being opposed to the first surface, wherein the conductive strip is separated from the ground plane by a separation distance, the separation distance being changed at at least one location along the conductive strip, wherein the antenna comprises a microstrip line that produces an electrically resonant frequency of the antenna; and electrically coupling a feed point to an intermediate portion of the conductive strip, the conductive strip including a first portion extending along the length of the conductive strip from the feed point and a second portion extending along the length of the conductive strip from the feed point away from the first portion, the first portion having a different length than the second portion.

16. The method of claim 15 wherein the antenna comprises a microstrip line that produces an electrically resonant frequency of the antenna that is lower than an electrically resonant frequency of a microstrip antenna of the same configuration but with a uniform conductive element separation distance.

17. The method of claim 15 wherein said separation distance between the conductive strip and the ground plane is changed at an angle of about 90° along the length of the conductive strip.

18. The method of claim 15 further comprising configuring another conductive element over a side of the ground plane opposing the conductive strip, the another conductive element being insulated from the ground plane except at a point.

19. The method of claim 18 wherein the another conductive element has an end that is proximate an edge of said ground plane.

20. The method of claim 18 wherein an insulating material having a varied thickness is disposed between the another conductive element and said ground plane.

21. The method of claim 20 wherein the thickness of the insulating material disposed between the another conductive element and said ground plane varies abruptly at at least one location.

22. The method of claim 15 and further comprising applying a lossy magnetic material over at least a portion of said ground plane.

23. An RF communication device comprising:

a transmitter;

a receiver; and an antenna coupled to the transmitter and receiver, the antenna having a conductive strip, a ground plane separated from the conductive strip by a separation distance that varies at at least one location along a length of the conductive strip, and a feed point electrically coupled to an intermediate portion of the conductive strip, the conductive strip including a first portion extending along the length of the conductive strip from the feed point and a second portion extending along the length of the conductive strip from the feed point away from the first portion, the first portion having a different length than the second portion.

24. The device of claim 23 wherein the antenna comprises a microstrip line that produces an electrically resonant frequency of the antenna that is lower than an electrically resonant frequency of a microstrip antenna of the same configuration but with a uniform conductive element separation distance.

25. The device claim 23 wherein said separation distance between the conductive strip and the ground plane is changed abruptly along the length of the conductive strip.

26. The device of claim 23 wherein changes to said separation distance are made at at least two symmetrically configured locations along the length of conductive strip.

27. The device of claim 23 and further comprising a lossy magnetic material disposed over at least a portion of the ground plane.

28. The device of claim 23 and further comprising another conductive element disposed over a side of the ground plane.

29. The device of claim 28 wherein the another conductive element has an end tat is proximate an edge of said ground plane.

30. The device of claim 28 and further comprising an insulating material having a varied thickness disposed between the another conductive element and said ground plane.

31. The device of claim 30 wherein the thickness of the insulating material disposed between the another conductive element and said ground plane varies abruptly at at least one location.

32. The device of claim 23 wherein the RF communication device comprises a cellular telephone.

33. The device of claim 23 wherein the RF communication device comprises a RF identification tag.

34. An antenna comprising:

an insulating substrate;

a conductive strip disposal on a first surface of the substrate, the conductive strip having a characteristic impedance that may vary along its length; and a ground plane disposed on a second surface of the substrate, the second surface being opposed to the first surface, wherein the conductive strip is separated from the ground plane by a separation distance such that the separation distance is greater in a first region than in a second region; and a feed point electrically coupled to an intermediate portion of the conductive strip, the intermediate portion located in the first region where the separation distance is greater, the conductive strip including a first portion extending along the length of the conductive strip from the feed point and a second portion extending along the length of the conductive strip from the feed point away from the first portion.

35. The antenna of claim 34, wherein the separation distance is changed at an angle of about 90° at a location where the first region meets the second region.

* * * * *

UNITED STATES PATENT AND TRADEMARK OFFICE

CERTIFICATE OF CORRECTION

PATENT NO. : 7,079,077 B2
APPLICATION NO. : 10/770540
DATED : July 18, 2006
INVENTOR(S) : Lee It is certified that error appears in the above-identified patent and that said Letters Patent is hereby corrected as shown below:

In the Claims

Column 18, Line 28: delete "tat" and insert --that--.

Signed and Sealed this

Twenty-first Day of November, 2006

JON W. DUDAS
*Director of the United States Patent and Trademark Office*